US006260502B1

(12) United States Patent
Kratz et al.

(10) Patent No.: US 6,260,502 B1
(45) Date of Patent: Jul. 17, 2001

(54) SEMI-SUBMERSIBLE VESSEL

(76) Inventors: Owen Kratz, 2503 Crescent Shores Dr., LaPorte, TX (US) 77571; Hank Ketting, 39 Berglaan, Woensdrecht 463416 (NL); Stanley Groedecke Kellogg, 7803 Feather Spr., Houston, TX (US) 77095

( * ) Notice: Subject to any disclaimer, the term of this patent is extended or adjusted under 35 U.S.C. 154(b) by 0 days.

(21) Appl. No.: 09/246,618

(22) Filed: Feb. 8, 1999

Related U.S. Application Data

(63) Continuation-in-part of application No. 09/052,540, filed on Mar. 31, 1998, now Pat. No. 6,009,820.

(51) Int. Cl.[7] ..... B63B 35/44
(52) U.S. Cl. ..... 114/264; 114/265
(58) Field of Search ..... 114/264, 265, 114/266, 253, 254, 44, 50, 51

(56) References Cited

U.S. PATENT DOCUMENTS

| | | | |
|---|---|---|---|
| Re. 32,589 | 2/1988 | Goldman et al. | 405/198 |
| 234,794 | 11/1880 | Lundborg . | |
| D. 270,907 | 10/1983 | Younea | D12/316 |
| D. 271,098 | 10/1983 | Younea | D12/316 |
| 524,243 | 8/1894 | Bulette . | |
| 795,002 | 11/1905 | Nelson . | |
| 1,167,723 | 1/1916 | Scott . | |
| 1,440,644 | 1/1923 | Stromberg . | |
| 1,904,027 | 4/1933 | Field . | |
| 1,905,488 | 4/1933 | Nack . | |
| 1,911,427 | 5/1933 | Bureau . | |
| 1,911,428 | 5/1933 | Bureau . | |
| 1,920,205 | 8/1933 | Lowy . | |
| 2,229,796 | 1/1941 | Carlson | 242/110 |
| 2,233,449 | 3/1941 | Glenny | 242/115 |
| 2,375,286 | 5/1945 | Creed . | |
| 2,889,795 | 6/1959 | Parks | 114/0.5 |
| 3,163,147 | 12/1964 | Collipp | 114/0.5 |
| 3,237,438 | 3/1966 | Tesson | 72/160 |
| 3,246,476 | 4/1966 | Wolff | 61/46.5 |
| 3,279,407 | 10/1966 | Stenger | 114/66.5 |
| 3,447,502 | 6/1969 | Leopold | 114/61 |
| 3,490,406 | 1/1970 | O'Reilly et al. | 114/0.5 |
| 3,556,033 | 1/1971 | Bonnafous | 114/0.5 |
| 3,623,444 | 11/1971 | Lang | 114/61 |
| 3,645,468 * | 2/1972 | Edelberg et al. | 242/373 |
| 3,653,354 | 4/1972 | Pangalila | 114/125 |
| 3,658,222 | 4/1972 | Dressel et al. | 226/25 |
| 3,691,977 | 9/1972 | Eubanks et al. | 114/51 |
| 3,822,559 | 7/1974 | Matthews, Jr. | 61/72.3 |
| 3,949,693 | 4/1976 | Bauer et al. | 114/0.5 |

(List continued on next page.)

FOREIGN PATENT DOCUMENTS

| | | |
|---|---|---|
| 1279531 | 1/1991 | (CA) . |
| 120831 | 1/1972 | (GB) . |
| 1481562 | 8/1977 | (GB) . |

OTHER PUBLICATIONS

Roy D. Gaul, et al. Design of Semisubmerged Swath Research & Survey Ship, Proceedings on the Oceans '88 conference (1988).

(List continued on next page.)

*Primary Examiner*—Stephen Avila
(74) *Attorney, Agent, or Firm*—Fulbright & Jaworski L.L.P.

(57) ABSTRACT

An uncrossed-braced, column stabilized semi-submersible and improved methods of operation of the same are disclosed. The semi-submersible vessel provides necessary strength to resist hydrodynamic forces via a unitized support system. Improved elliptically shaped columns, haunch supports and reinforcing members provide stability and resist transverse forces. A skirt design minimizes the reduced stability at the transition point. Improved deck designs reduce environmental impacts and provide additional support against transverse forces.

16 Claims, 36 Drawing Sheets

U.S. PATENT DOCUMENTS

| | | | |
|---|---|---|---|
| 3,982,402 | 9/1976 | Lang et al. | 61/109 |
| 3,991,584 | 11/1976 | Golbach | 61/111 |
| 4,157,023 | 6/1979 | Tisdale | 72/161 |
| 4,174,671 | 11/1979 | Seidl | 114/61 |
| 4,215,950 | 8/1980 | Stevenson | 405/195 |
| 4,218,906 | 8/1980 | Yoshida | 72/183 |
| 4,243,345 | 1/1981 | Cha et al. | 405/168 |
| 4,260,287 | 4/1981 | Uyeda et al. | 405/168 |
| 4,269,540 | 5/1981 | Uyeda et al. | 405/168 |
| 4,286,896 | 9/1981 | Melitz et al. | 405/185 |
| 4,297,054 | 10/1981 | Yenzer et al. | 405/168 |
| 4,345,855 | 8/1982 | Uyeda et al. | 405/168 |
| 4,436,050 | 3/1984 | Lider | 114/265 |
| 4,498,412 | 2/1985 | Lidén | 114/264 |
| 4,538,937 | 9/1985 | Lynch | 405/168 |
| 4,570,716 | 2/1986 | Genini et al. | 166/346 |
| 4,594,871 | 6/1986 | de Boer | 72/164 |
| 4,652,177 | 3/1987 | Gunther, Jr. et al. | 405/196 |
| 4,657,437 | 4/1987 | Breeden | 405/198 |
| 4,663,955 | 5/1987 | Redman | 72/129 |
| 4,687,376 | 8/1987 | Recalde | 405/168 |
| 4,716,847 | 1/1988 | Wilson, Jr. | 114/61 |
| 4,721,410 | 1/1988 | Recalde | 405/166 |
| 4,721,411 | 1/1988 | Recalde | 405/168 |
| 4,723,874 | 2/1988 | Recalde | 405/168 |
| 4,735,526 | 4/1988 | Kawagoe et al. | 405/196 |
| 4,789,108 | 12/1988 | Recalde | 242/54 |
| 4,802,794 | 2/1989 | Lynch | 405/168 |
| 4,810,132 | 3/1989 | Diehl | 405/166 |
| 4,813,869 | 3/1989 | Gatewood | 433/18 |
| 4,820,082 | 4/1989 | Recalde | 405/168 |
| 4,902,169 | 2/1990 | Sutton | 405/204 |
| 4,913,591 | 4/1990 | Steele | 405/196 |
| 4,917,540 | 4/1990 | Recalde | 405/168 |
| 4,961,671 | 10/1990 | Recalde | 405/168 |
| 4,984,934 | 1/1991 | Recalde | 405/168 |
| 5,038,702 | 8/1991 | Bowes | 114/265 |
| 5,111,677 | 5/1992 | del Fabro et al. | 72/164 |
| 5,139,366 | 8/1992 | Choate et al. | 405/198 |
| 5,188,484 | 2/1993 | White | 405/198 |
| 5,236,145 | 8/1993 | Floury et al. | 242/116 |
| 5,348,423 | 9/1994 | Maloberti et al. | 405/166 |
| 5,377,517 | 1/1995 | Kato | 72/164 |
| 5,527,134 | 6/1996 | Recalde | 405/168.32 |
| 5,533,834 | 7/1996 | Recalde | 405/168.3 |
| 5,555,838 | 9/1996 | Bergman | 114/265 |
| 5,575,592 | 11/1996 | Pollack | 405/223.1 |
| 5,580,187 | 12/1996 | Jordan | 405/166 |
| 5,655,753 | 8/1997 | Berges et al. | 254/134.3 |
| 5,676,009 | 10/1997 | Bright et al. | 72/161 |
| 5,692,859 | 12/1997 | Dickson et al. | 405/168.4 |
| 5,836,719 | 11/1998 | Martin et al. | 405/166 |
| 5,893,682 | 4/1999 | Oliveri | 405/166 |

OTHER PUBLICATIONS

Alan C. McClure & Associates, Inc., General Arrangement Forward/AFT and Elevation (Aug. 27, 1998).

R. D. Gaul & A. C. McClure, Development of the Swath Ship concept for Research Design Ship, Proceedings of Oceans (1984).

Alan C. McClure & Roy D. Gaul, Let Swath, Proceedings (Apr. 1987).

R. D. Gand et al., Semi–Ship Favored As Crew Transporter, Offshore Europe (Oct. 5, 1981).

Alan C. McClure Assoc. Inc., General Arrangement Outboard Platform (Aug. 1996).

* cited by examiner

SEMI-SUBMERSIBLE VESSEL

The present invention is a continuation-in-part of U.S. patent application Ser. No. 09/052,540 filing date Mar. 31, 1998 U.S. Pat. No. 6,009,820.

BACKGROUND OF INVENTION

This invention relates to a semi-submersible vessel used in connection with offshore operations, services and resource exploration. More particularly, this invention relates to (1) a hybrid of a column stabilized semi-submersible vessel which expands the useful operations and life thereof and (2) improved methods of performing offshore operations, services and resource exploration therewith.

Increased energy demands and decreased energy resources have created a need to explore and produce resources from deeper offshore areas. The demands of deep water exploration and installation present many technical problems for vessel designers. Existing technology used in offshore operations, services and resource exploration fails to adequately address the many challenges associated with deep water.

Placement of equipment in deep waters necessitates new methods of installation, maintenance, repair and removal. For example, rapid transit speed combined with installation and removal capabilities are desired features which are inadequate in existing designs. Service and maintenance needs related to equipment placed in extreme depths, e.g., flow lines, jumpers, tie-ins and service umbilicles, presents significant issues which known technology fails to adequately address. The time frames associated with installation, maintenance, repair and removal services precludes the use of mooring systems in deep water. Thus, efficient station keeping techniques are required. In addition, improved methods for loading, unloading and provision of installation, maintenance, repair and removal services are required.

One type of vessel used in deep waters is known as a semi-submersible vessel. A semi-submersible vessel comprises a deck section which is typically supported by four or more vertical columns which rest on two or more pontoons. The pontoons and portions of the columns are submerged below the operational water line during normal operation. In order to provide adequate structural integrity, cross brace support members are typically used between the columns. Cross brace support members, while essential to the structural integrity of traditional designs for semi-submersible vessels, create undesirable characteristics. For example, cross brace support members create hydrodynamic drag and create problems related to underslung loads. In addition, cross brace support members preclude easy and efficient loading and reloading of vessels.

U.S. Pat. No. 4,436,050 illustrates a hybrid of a traditional cross braced semi-submersible vessel. In the disclosed vessel, a pair of support members run generally parallel between the pontoons. Such an alternative design fails to fully address performance and operational issues.

Canadian Patent No. 1,279,531 discloses a semi-submersible vessel without any cross bracing, but fails to disclose means which would adequately support such a structure.

Thus, a need remains for an improved semi-submersible vessel design with expanded capabilities, and alternative structural supports which do not unnecessarily interfere with advantageous operations of such vessels and methods for maximizing the efficiency and operation of the same.

SUMMARY OF INVENTION

It is therefore an object of the present invention to provide an improved semi-submersible vessel which does not require cross-bracing.

A further object of the present invention is to provide an improved column design which can be incorporated into a semi-submersible vessel.

Another object of the present inventions is to provide an improved method and apparatus for loading a semi-submersible vessel.

A further object of the present invention is to provide an improved and cassette mechanism which improves vessel capabilities.

Another object of the present invention is to provide a reel cassette mechanism with improved failure characteristics.

Yet another object of the present invention is to provide an improved method for loading underslung loads onto a semi-submersible vessel.

Thus to achieve these objects, there is provided in one embodiment of the present invention an improved design for a semi-submersible vessel which includes a deck supported by columns and a haunch means. More particularly, in one embodiment of the present invention, there is provided a vessel comprising two pairs of columns, the first pair being connected to a first pontoon and the second pair being connected to a second pontoon and haunch means which connects the first and second pair of columns to a deck.

In a preferred embodiment, the haunch means comprises a diagonal structure which flares inboard and connects the column to an upper box structure. More particularly, there is provided elliptically shaped columns which more evenly distribute forces. Further preferred, the columns comprise internal bulkheads, which preferably expand in way of the haunch and connect to the upper box structure. In a most preferred embodiment, the columns are elliptically shaped, and include two or more internal bulkheads.

In another aspect of the present invention, there is provided improved elliptical columns for use in a semi-submersible vessel. In a preferred embodiment, the columns include a flared skirt. Most preferred, the skirt flares at an angle from about thirty to about sixty degrees.

In another aspect of the present invention there is provided an improved structural design which further incorporates multiple decks as support members in a unitized structure. More particularly, there is provided a double bottom structure, which includes a first deck, a second deck and a wet deck. Preferably, the wet deck and the second deck are connected by a plurality of support members. Further preferred, the wet deck and the second deck are connected to the columns by a haunch means. The integration of structural components creates a continuous unitized structure.

In another aspect of the present invention, there is provided an improved method for loading or carrying an underslung load. More particularly, there is provided an improved method which includes the steps of placing a barge or similar load carrying vessel under a semi-submersible vessel, lowering a line or lines from said semi-submersible vessel, connecting the lowered line or lines to a load and raising the load. In a particularly preferred embodiment the method include the steps of positioning a transport vessel underneath a semi-submersible vessel, aligning product with a lifting means, raising the loaded product to the undersided of the semi-submersible vessel, and securing the product to the underside with a fastening means. A preferred method for aligning the product is by use of lasers positioning devices. A preferred lifting device is a vehicle hydraulic cylinder. A preferred fastening device is a male/female hydraulic engagement.

In another aspect of the present invention, there is provided a method for installing product comprising the steps of securing a loaded reel to the underside of a semi-submersible vessel, attached a lead line to the product of the reel, unspooling the product with the lead line, associating the product with a dead weight and lowering the dead weight to an installation site. In a preferred embodiment, two or more reels may be secured to the underside of a semi-submersible vessel, whereby either product may be continuously installed from a first and a second reel or two different products may be simultaneously installed. Preferably, the moon pool of the semi-submersible is enlarged to a size which allows for materials and other apparatus to be directly loaded from the underside of the vessel from a transport vessel or other feed source.

In yet another aspect of the present invention there is provided a reel and cassette mechanism with improved failure characteristics. More particularly, there is provided a reel which holds product and includes a horizontal surface and a cylinder, a cassette including a bottom, and an air inlet, and an air compressor. Preferably, the horizontal surface of the reel is positioned adjacent to the bottom of the cassette and the air compressor supplies air whose force per square inch is greater than the weight of the reel and its associated product, whereby an air cushion is created between the horizontal surface and bottom.

In a particularly preferred embodiment, there is provided an adaptable reel. More particularly, the diameter of the cylinder may be increased or decreased so that product of different banding stresses may be accommodated. Additionally, the preferred reel includes an adaptable horizontal surface whose diameter may be increased or decreased, whereby additional product may be accommodated or the reel may be accommodated to multiple cassettes.

Other objects, features and advantages of the present invention will become apparent from a review of the detailed description of the preferred embodiments, including the illustrative drawings and the appended claims which follow.

BRIEF DESCRIPTION OF DRAWINGS

FIG. 10*c* is a sectional view of the columns of vessel of FIG. 2.

FIGS. 13*a*, 13*b*, 13*c*, 13*d*, 13*f* and 13*g* top views of the semi-submersible vessel of FIG. 2, which illustrate a preferred method for positioning a product carrying vessel underneath a semi-submersible vessel.

DETAILED DESCRIPTION OF THE PRESENT INVENTION

The present invention provides a mobile vessel designed to accomplish a variety of functions at an offshore site. In contrast to known vessel designs and improvements, the present invention provides a stable semi-submersible vessel design with expanded capabilities, without support members which impair hydrodynamic properties and the useful operation of such a vessel.

As discussed above, depleted energy resources and increased energy demand has created a need for a deep water resource exploration and service vessel. The usefulness of existing semi-submersible vessel designs is somewhat limited because prior designs have unnecessarily limited transit speeds and the normal operations of such vessels.

The primary structural forces on a semi-submersible vessel are in the transverse direction. As used herein, transverse forces are those forces with a direction generally perpendicular to the pontoons of a semi-submersible vessel. In traditional semi-submersible vessels, a truss system is used to counteract transverse forces and provide structural integrity.

Figure 1:
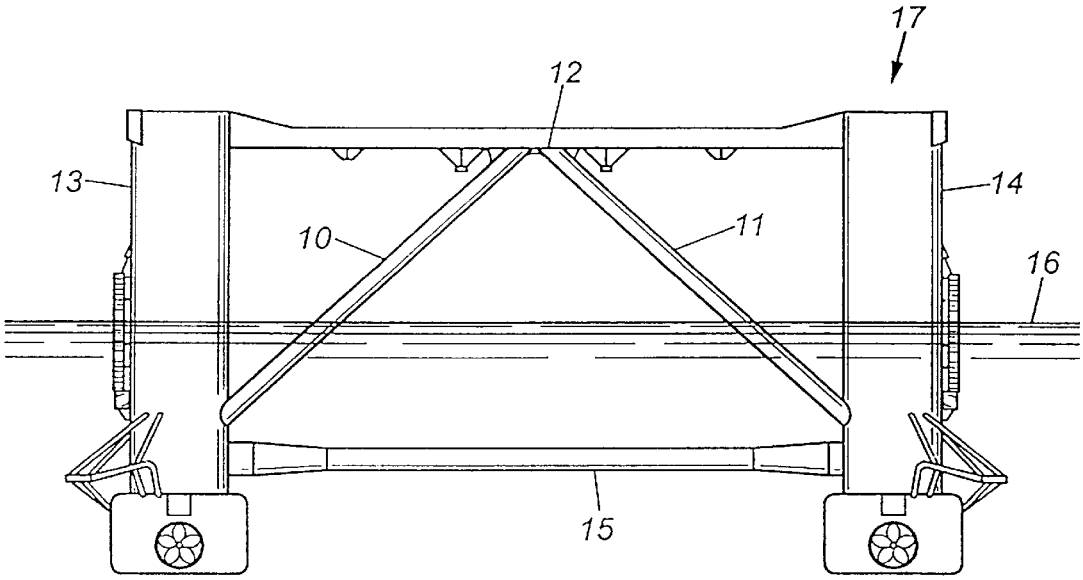
FIG. 1 is an end view of a prior cut cross braced semi-submersible vessel.
Figure 2:
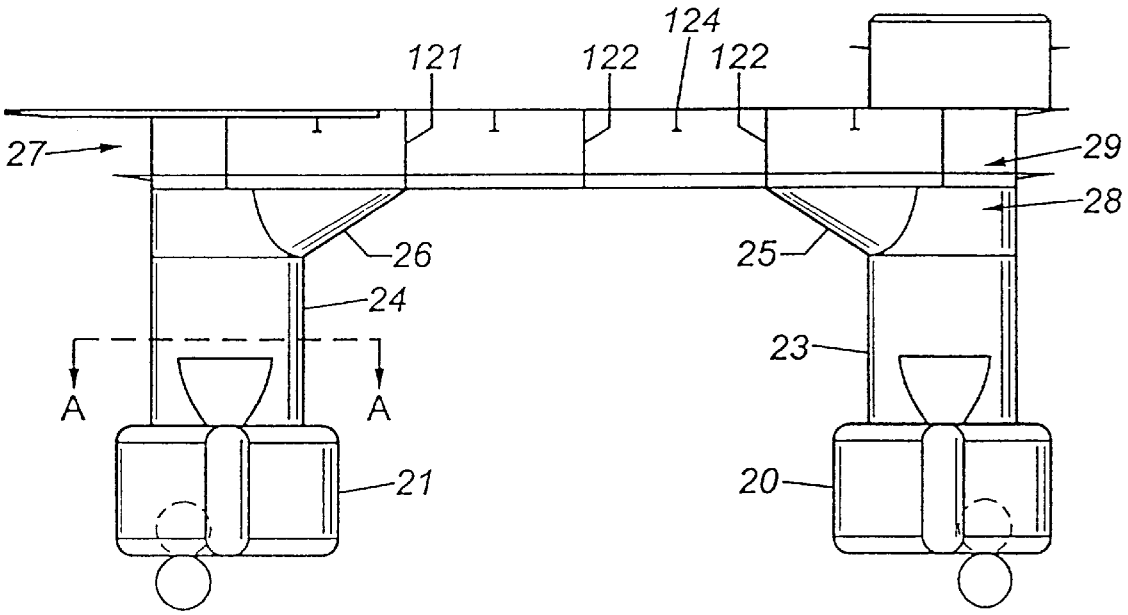
FIG. 2 is an elevation view of the bow of a vessel which illustrates the current invention.
Figure 3:
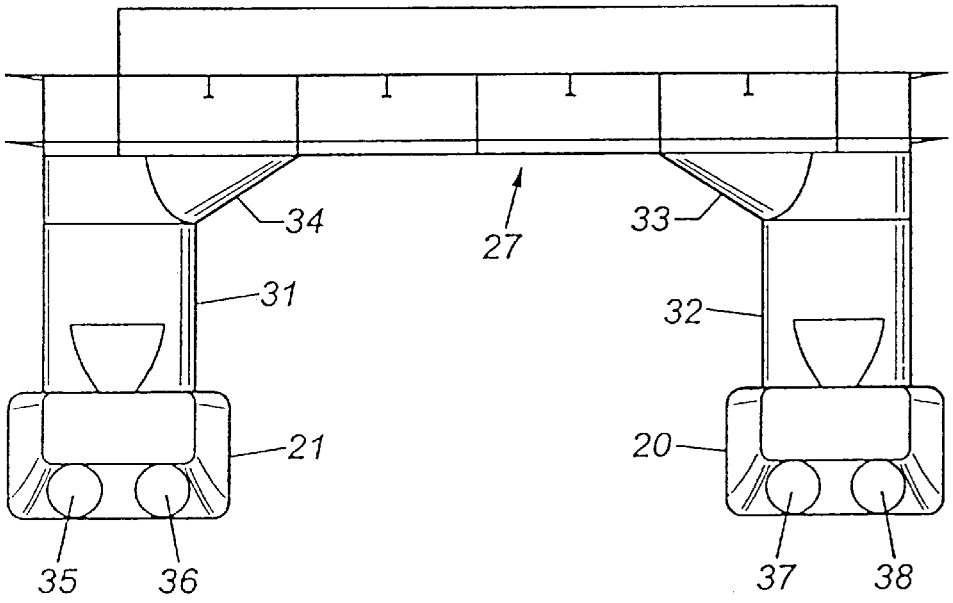
FIG. 3 is an elevation view of the stern of the vessel of FIG. 2.
Figure 4A:
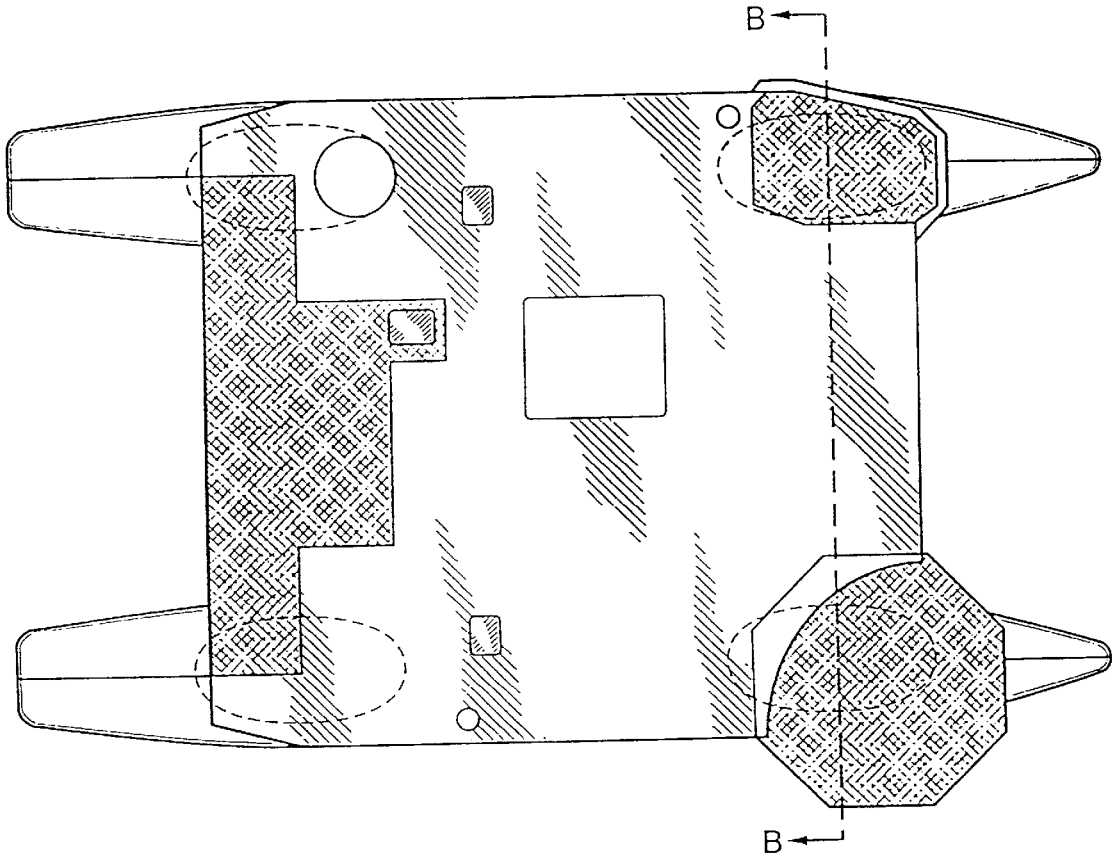
FIG. 4*a* is a top view of the first deck of the vessel of FIG. 2.

Referring first to FIG. 1 of the drawings, designs of semi-submersible vessels known in the art may be better understood. A typical truss design is shown. The truss comprises a first and a second diagonal support member 10 and 11 which run from the deck 12 to the first and second columns 13 and 14. An additional horizontal support member 15 is completely below the operational water line 16, and a significant portion of the first and second diagonal support members are also below the operational water line 16.

Semi-submersible vessels are by their nature mobile but also face the challenge of maintaining constant position. Incorporating additional cross brace structures under the operational water line 16 creates undesirable hydrodynamic drag. Current and waves impacting diagonal support member 10 and 11 and horizontal support member 15 adversely affect station keeping performance. In a similar manner, such members adversely limit transit speed of such a vessel. Further, the incorporation of diagonal support member 10 and 11 and horizontal support member 15 impairs the vessels ability to load and carry underslung loads.

In a vessel such as the semi-submersible shown in FIG. 1, a large load may be handled by a method known to those skilled in the art as keel hauling. The keel hauling method requires the steps of lowering a line (not shown) below the operational water line 16, taking the line under the horizontal support member 15, raising the line above the operational water line 16, connecting the line to a load (not shown) on a barge or other vessel (not shown). The load must then be lowered into the water independent of the semi-submersible, for example, by a derrick barge. When the load is lowered, the load is allowed to swing under the semi-submersible in a pendulum like manner, thereby transferring the load to the semi-submersible. Obviously, keel hauling creates certain operational risks.

Column Stabilized Unitized Structure

Referring now to FIGS. 2–9 of the drawings, the column stabilized unitized structure may be better understood.

In a service vessel used at multiple offshore sites, the combined functional requirements create new design considerations which known vessels have failed to adequately address. The current invention discloses novel designs which accomplish the desired functionality. A unitized structural system is disclosed which allows greater overall operational flexibility of the vessel, while reducing hydrodynamic drag. Furthermore, the unitized structural support of the current invention distributes forces over a greater overall area so as to minimize peak stresses and thereby maximize the fatigue life of the vessel.

Referring now to the drawings, the invention is embodied in an uncross-braced, column stabilized service vessel with the general features illustrated in FIGS. 2 through 11. The vessel includes two generally parallel pontoons 20 and 21 which are connected to preferably elliptically shaped column supports 23, 24, 31 and 32, which in turn support horizontal box 27, which is composed of structures between wet deck 28 and first deck 124. Preferably, haunch means 25, 26, 33 and 34 transfer forces into horizontal box 27.

Figure 5:
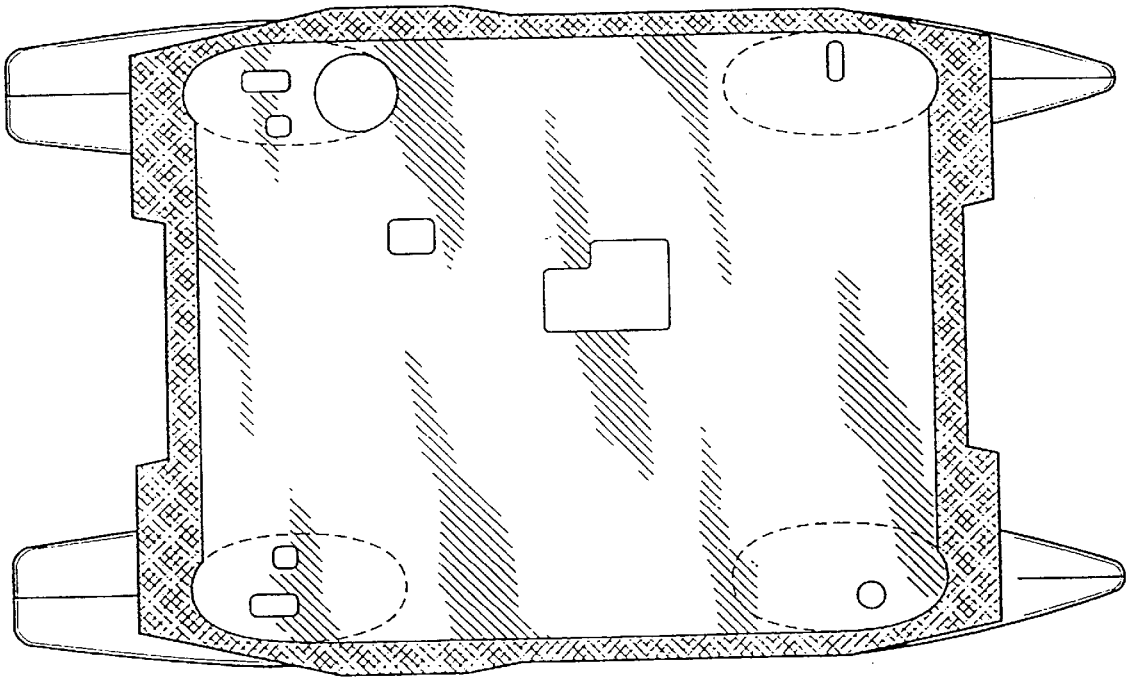
FIG. 5 is a top view of the second deck of the vessel of FIG. 2.
Figure 5A:
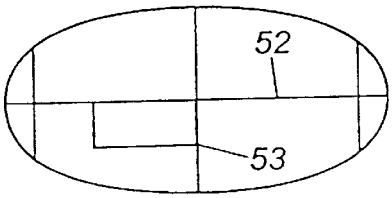
FIG. 5*a* is a cross-sectional view of a support column of the vessel of FIG. 2.
Figure 5B:
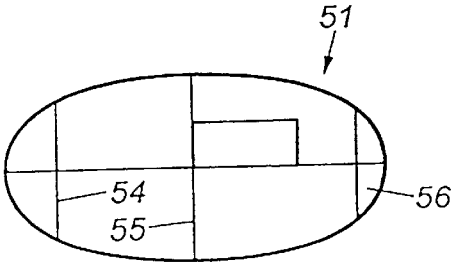
FIG. 5*b* is a cross-sectional view of another support column of the vessel of FIG. 2.
Figure 6:
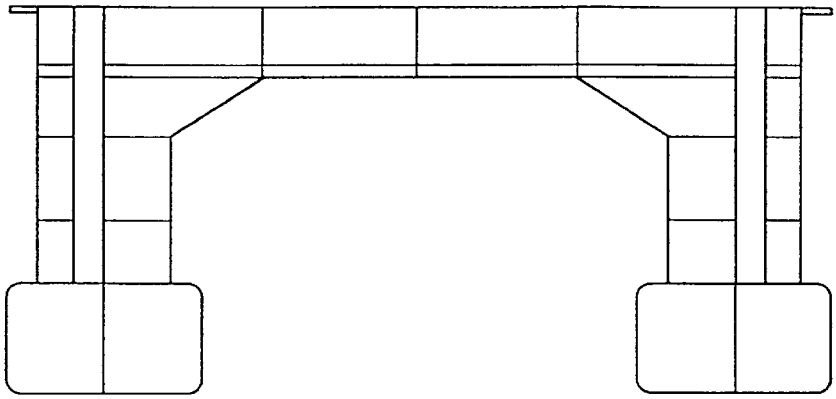
FIG. 6 is a cross sectional view of the vessel of FIG. 2 along Lines B—B of FIG. 4*a*.
Figure 7:
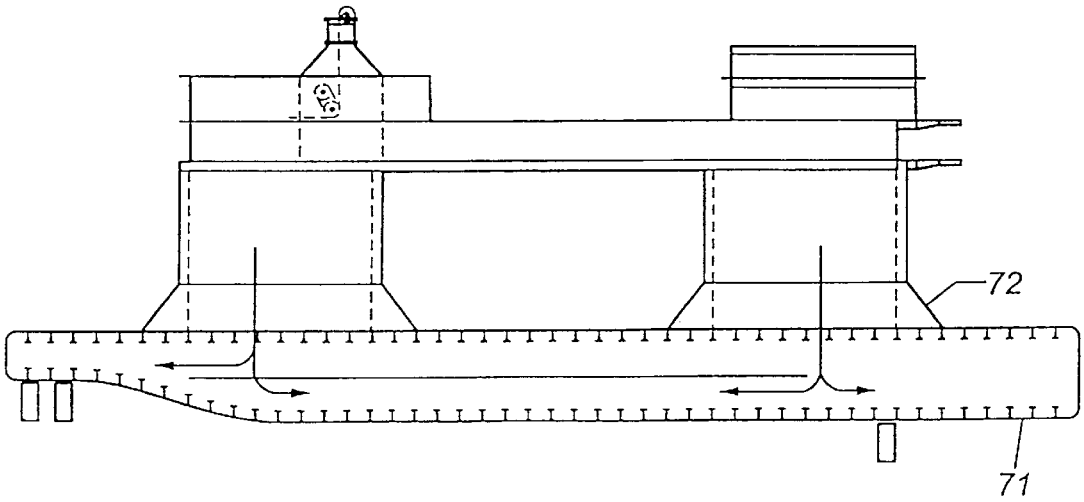
FIG. 7 is a side elevational view of the vessel of FIG. 2.

The elliptically shaped column supports comprise an outer shell 51 which is a primary strength member (See FIGS. 5*a* and 5*b*). The elliptically shaped column supports 23, 24, 31 and 32 each comprises a major axis 52 which is generally parallel to pontoons 20 and 21, a minor axis 53 which is generally perpendicular to pontoons 20 and 21. By elongating columns 23, 24, 31 and 32 along pontoons 20 and 21, enhanced ability to resist transverse forces, improved transition stability and increased transit speed are achieved. Preferably, the major axis 52 is from about one and a half to three times greater than the minor axis 53. Further preferred, the major axis is about one and three-quarters to two and one-quarter greater than the minor axis 53.

Semi-submersibles have in the past incorporated rectangular and rounded columns to support the upper deck over the pontoons. A rectangular column provides a good structural connection between the deck and the pontoons, but creates a high drag by virtue of its shape. Rounded columns create less drag than rectangular columns and such drag is independent of direction, but offer limited structural support between the pontoons and the upper deck. The unitized structure of the present invention incorporates elliptical columns which provide improved support against transverse forces. Stated otherwise, an elliptically shaped column offers greater structural support than a round column, without adding the hydrodynamic drag of a rectangular column. By way of example, assuming the minor axis 53 (FIG. 5*a*) of an elliptically shaped column is equal to the diameter of a circular column, an elliptically shaped column provides increased structural capacity as compared to the circular column. Such increase is equal to the ratio of the major axis of the elliptically shaped column divided by the diameter of the circle.

An elliptical shape has additional structural benefits. By using an elliptical shape, forces may be distributed over a greater area. By distributing the forces over a greater area, the useable life of the vessel is increased because fewer high stress points are incorporated into the vessel.

The elongated elliptical shape provides additional benefits. By elongating column supports 23, 24, 31 and 32, additional support against transverse forces may be incorporated internally to the column supports 23, 24, 31 and 32. The shape of a circular column inhibits the incorporation of multiple transverse bulkheads. Thus, in another aspect of the present invention there is disclosed enhanced bulkhead support members. Two or more generally parallel, transverse bulkheads may be incorporated in an elliptical structure. Three generally parallel bulkheads 54, 55, and 56 are preferably incorporated into each of the column supports 23, 24, 31, and 32 (see, e.g. FIG. 5*b*). The parallel bulkheads 54, 55 and 56 are preferably connected to, respectively, pontoon 20 or 21 and the horizontal box 27. The parallel bulk heads 54, 55 and 56 may be connected in manners well known to those skilled in the art of ship building, for example, by welding and the use of steel with through thickness properties.

Figure 8A:
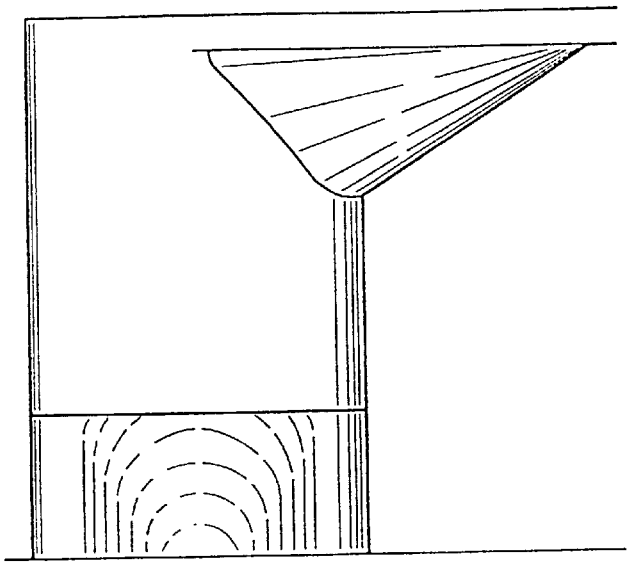
FIG. 8*a* is a longitudinal at elevation view of the column of the vessel of FIG. 2.
Figure 8B:
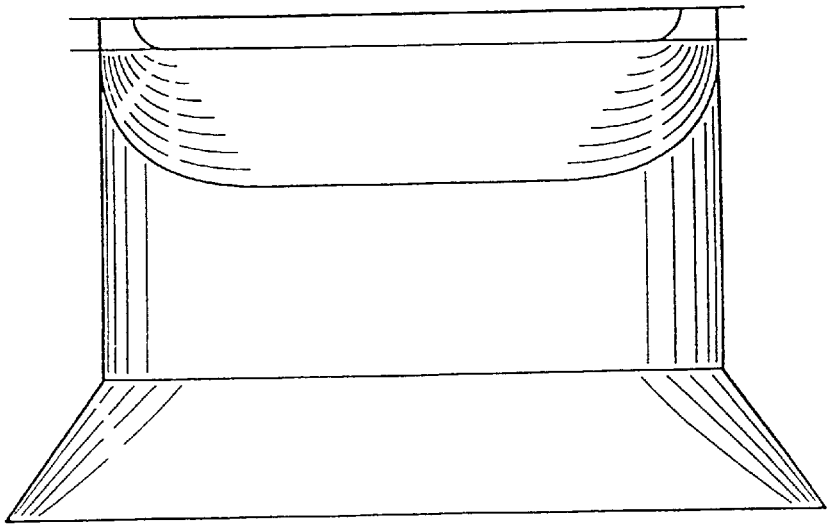
FIG. 8*b* is a transverse view of the column of the vessel in FIG. 2.
Figure 9:
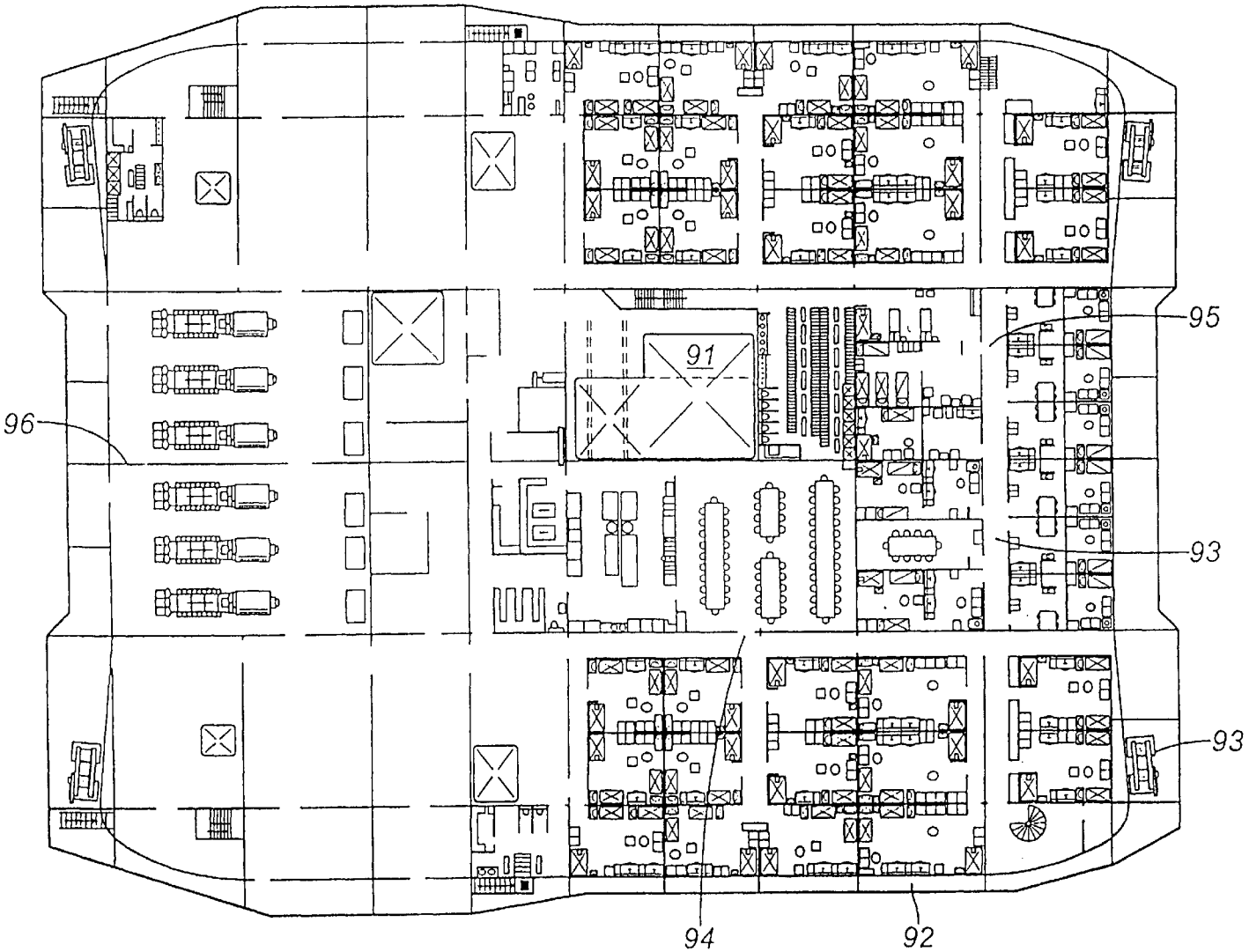
FIG. 9 is a transverse view of the column of the vessel in FIG. 2.

Preferably, the column supports 23, 24, 31 and 32 are connected to the horizontal box 27 with a haunch means 25, 26, 33 and 34, which transfers forces. In such a preferred embodiment, the skin or shell 51 of the column supports 23, 24, 31 and 32 flares in an inboard direction to create haunch means 25, 26, 34 and 33 (FIG. 8). Preferably, the included angle defined by the haunch means 25, 26, 33 and 34 and the horizontal box 27 is from about twenty to about sixty degrees. Most preferred, such angle is from about thirty to about forty five degrees.

Figure 10A:
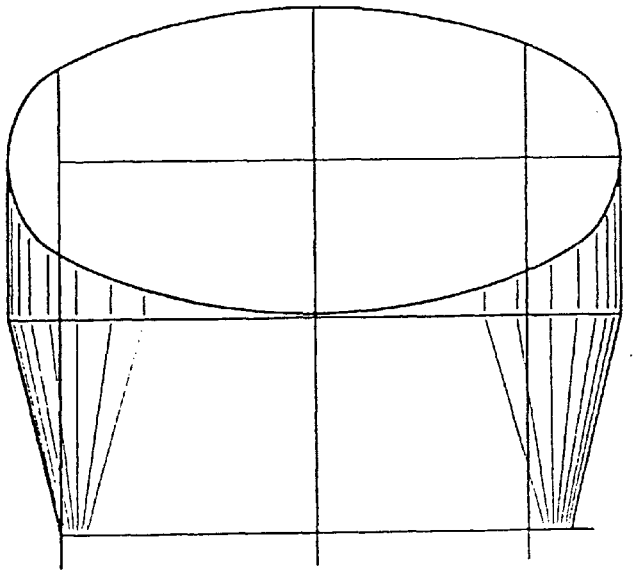
FIG. 10*a* a view of a preferred habitat incorporated into the vessel of FIG. 2.
Figure 10B:
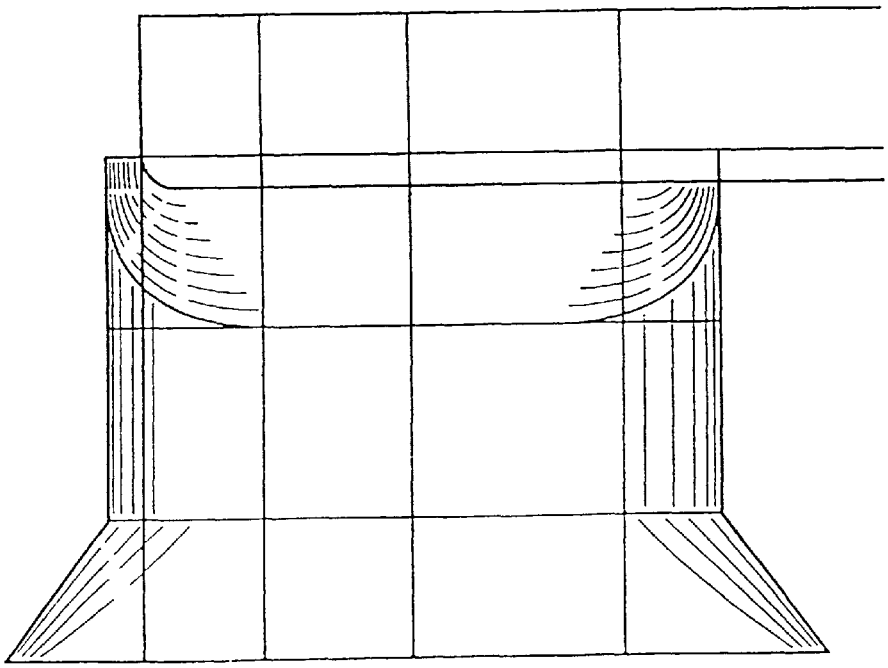
FIG. 10*b* is an elevation view of the columns of the vessel of FIG. 2 at the wet deck.
Figure 10C:
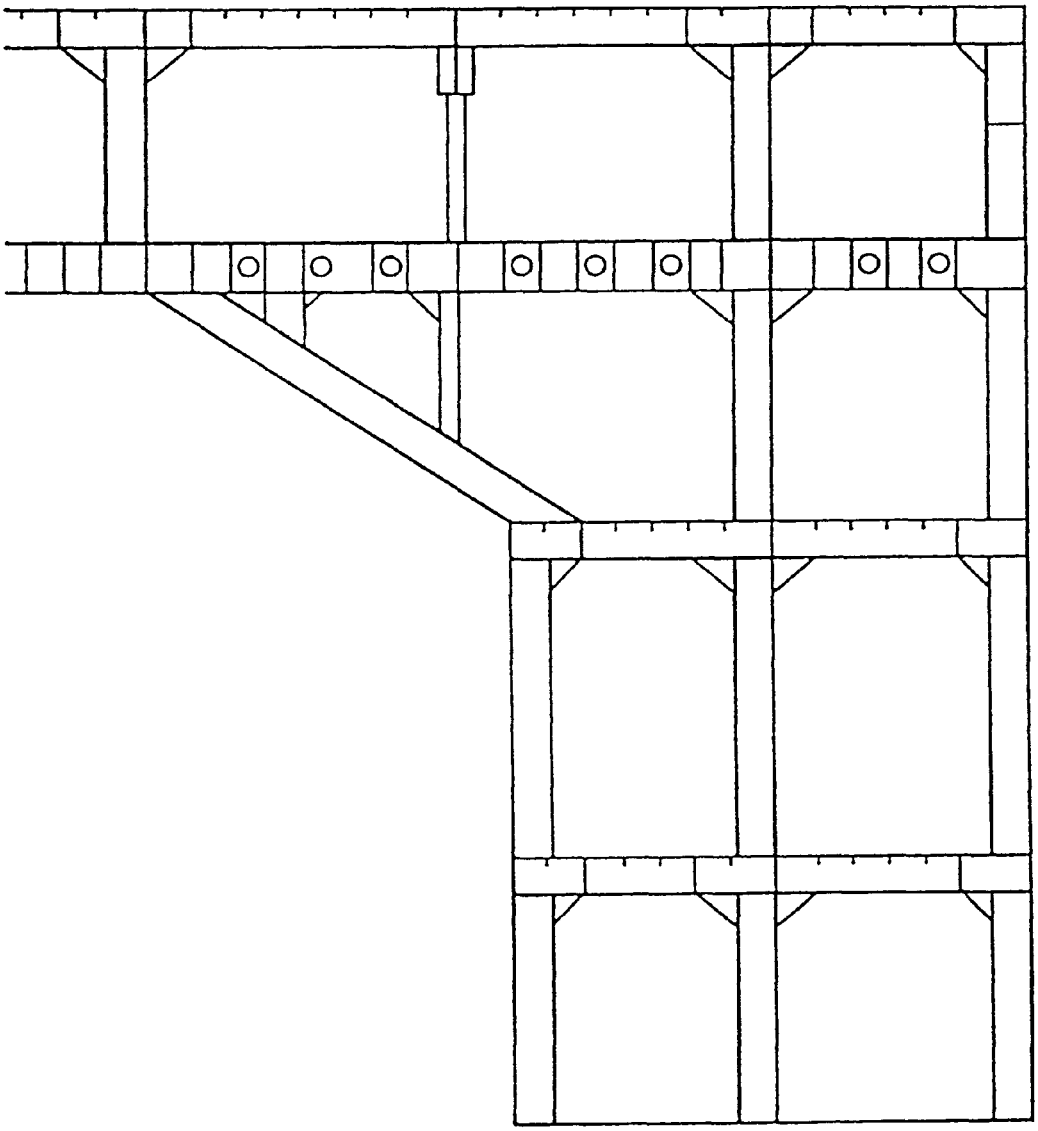
FIG. 10*c* is an elevation view of the columns of the vessel of FIG. 2.
Figure 11:
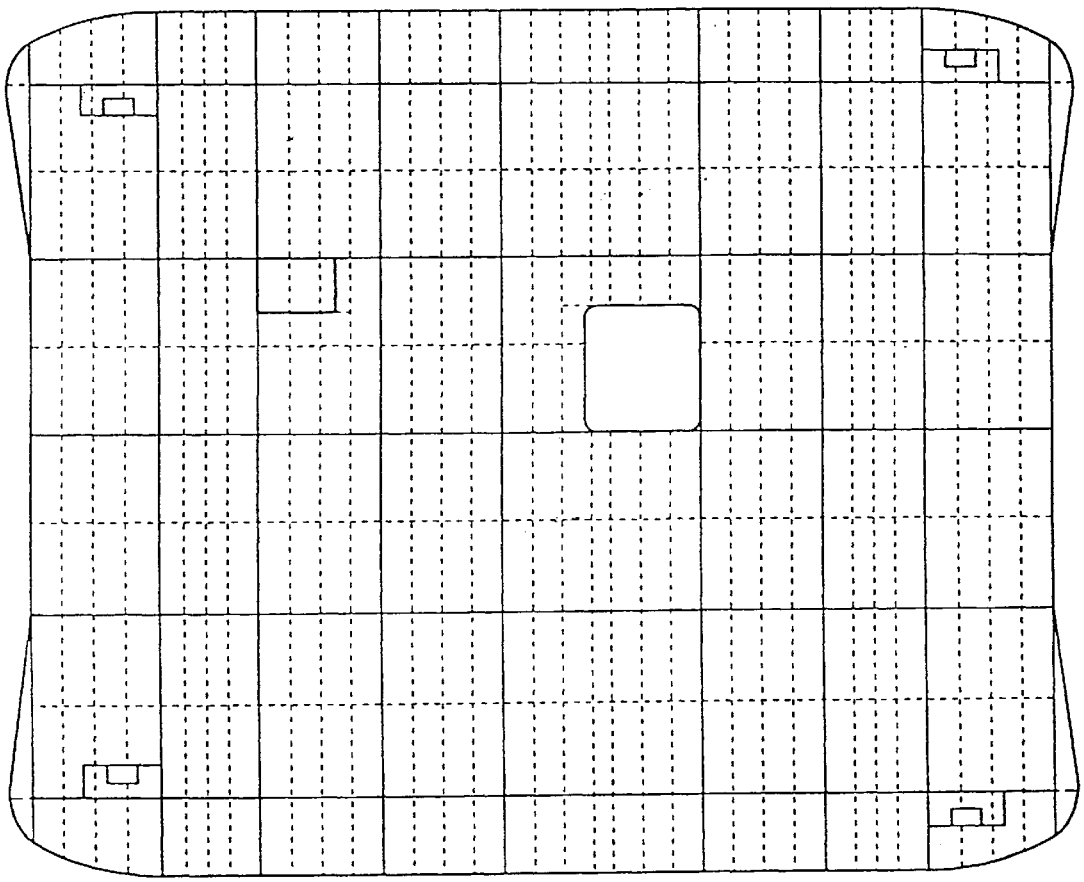
FIG. 11 is view of the second deck of the vessel of FIG. 2.
Figure 12A:
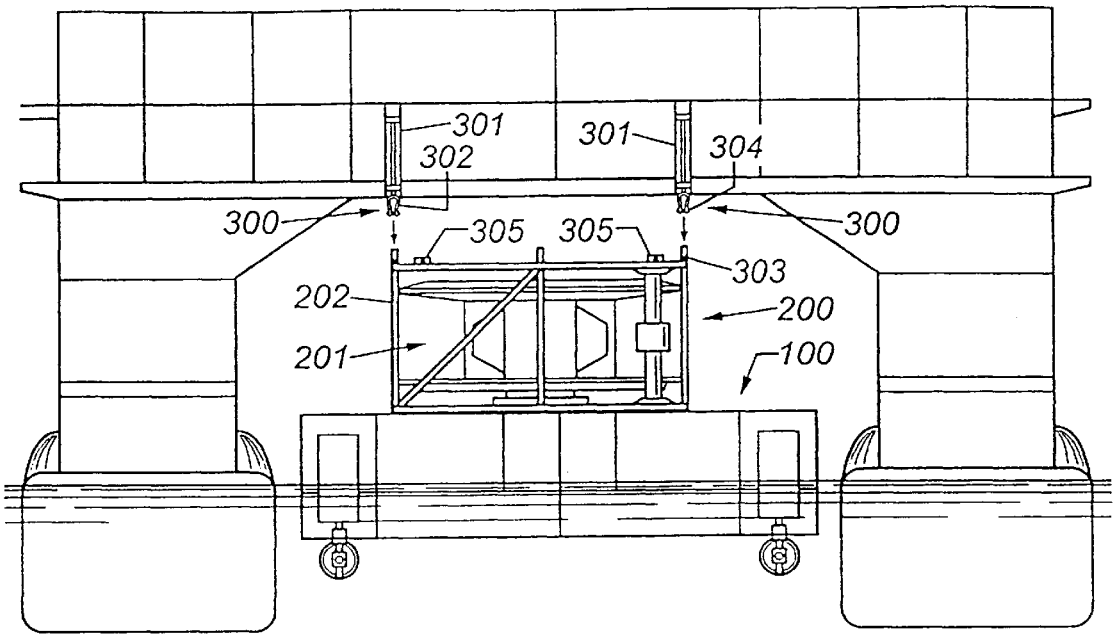
FIGS. 12*a*, 12*b*, 12*c*, and 12*d* are end views of the semi-submersible vessel of FIG. 2, which illustrate preferred methods for loading and securing product to the underside of a semi-submersible vessel.
Figure 12B:
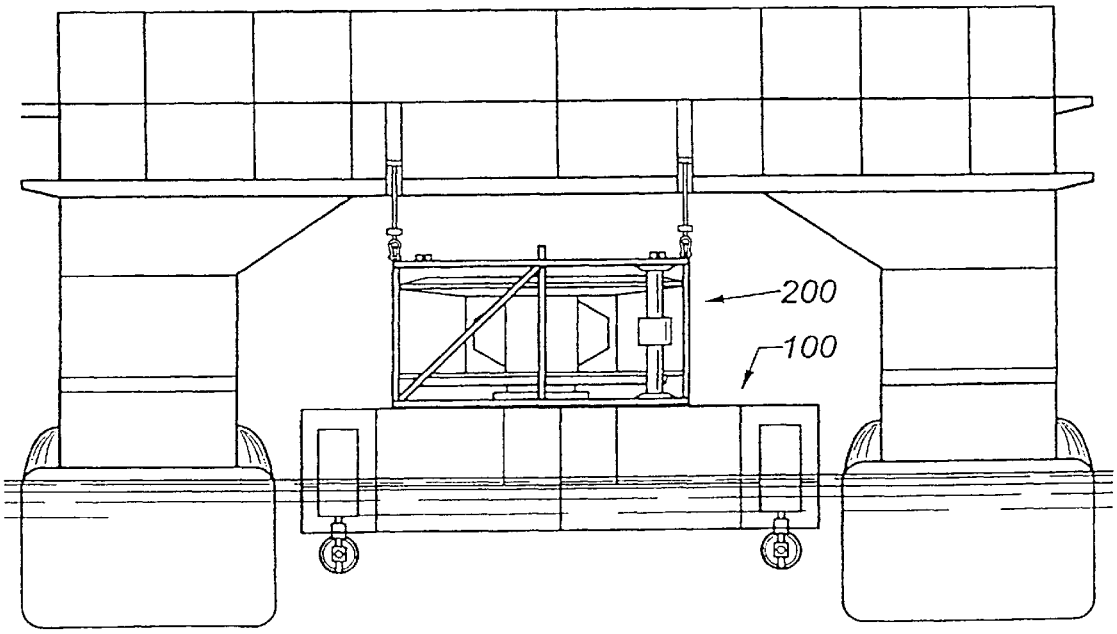
Figure 12C:
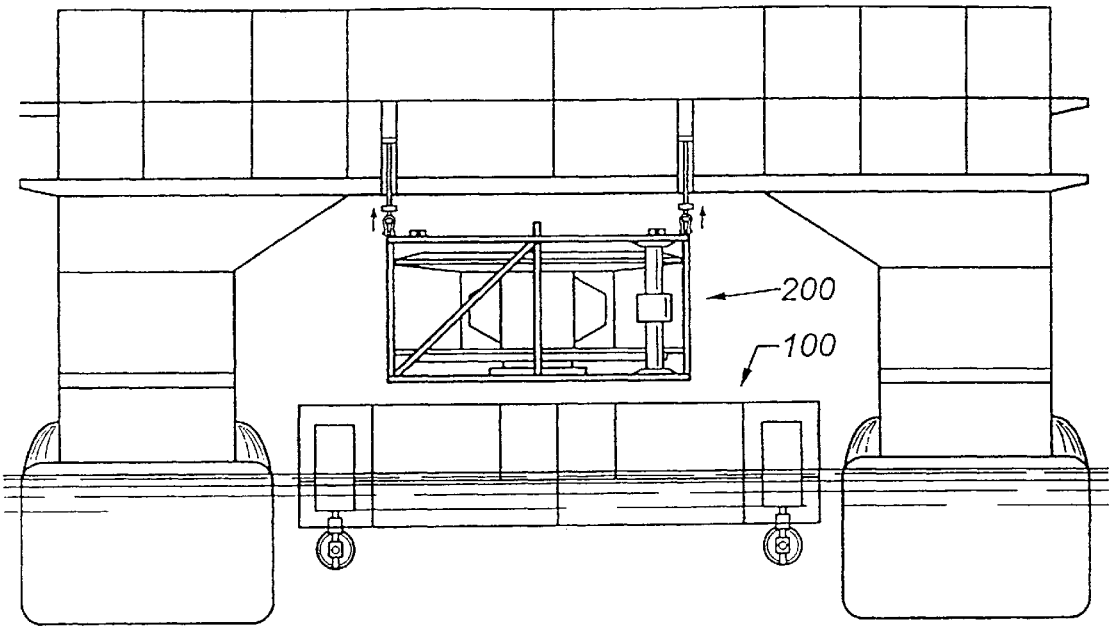
Figure 12D:
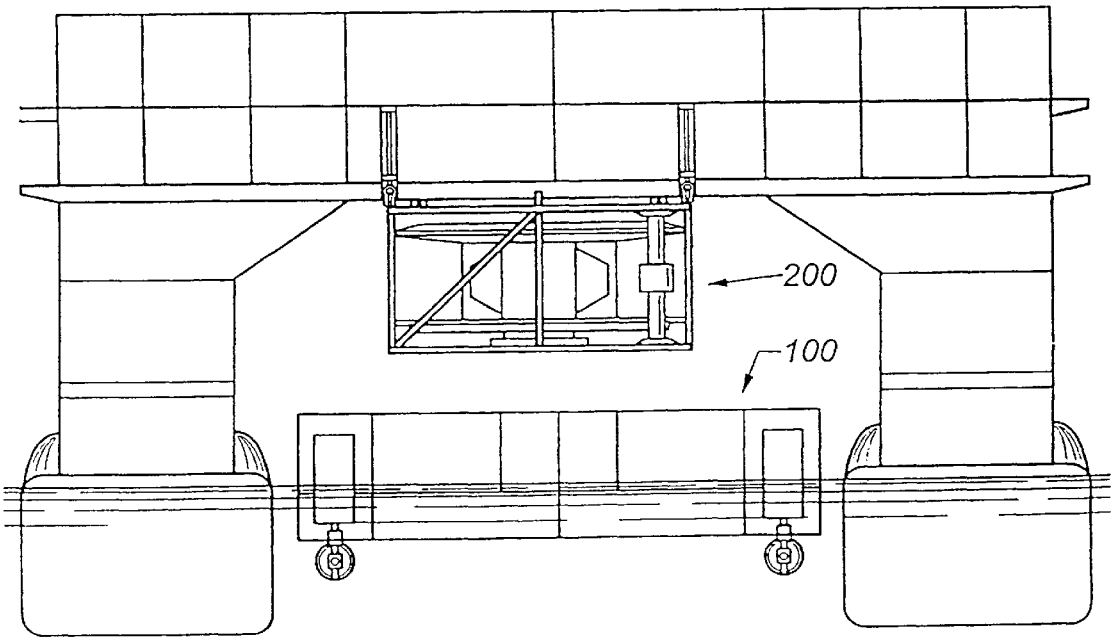

Preferably, the vertical bulkheads 54, 55 and 56 flare and expand in way of, haunch means 25, 26, 33 or 34. By flaring the vertical bulkheads 54, 55 and 56, additional support is provided to resist transverse forces. Additional support members 81 may also be provided internally to support columns 23, 24, 31 and 32 as shown in FIG. 10*c*. Further, horizontal support members 82 are preferably included within the support columns 23, 24, 31 and 32 to maintain the structural integrity of support columns 23, 24, 31 and 32.

Thus, the combination of elliptical columns, internal bulkheads and haunch supports provides a stable structure capable of resisting transverse forces. Beneficially, the transverse forces are adequately resisted without diagonal and horizontal support members. Accordingly, the present invention is well suited for multiple services, including transit, exploration, intervention, repair, installation and removal.

In another aspect of the present invention, there is provided an improved structural design which provides additional support to the horizontal box 27 described above. Traditional designs utilize a deck structure with exposed stiffeners. The stiffeners are required to prevent buckling of the deck. The stiffeners are exposed to corrosion.

The current invention discloses a double bottom structure capable of withstanding greater loads than traditional designs, while protecting the stiffeners 121 (FIG. 11) from corrosion. In a preferred embodiment, the improved deck design includes a wet deck 28, a second deck 29 and a first deck 124. Collectively, the wet deck 28, second deck 29 and first deck 124 define an improved horizontal box 27. Preferably, stiffener 121 connects second deck 29 and wet deck 28. In addition to providing increased resistance to the transverse forces, wet deck 28 provides an environmental barrier which limits the exposure of stiffener 121 to environmental conditions, and, thus, susceptibility to corrosion. Further, the double bottom space defined by wet deck 28 and second deck 29 creates space for storage, including fluid storage. Moreover, the double bottom space provides enhanced damage stability protection.

In another aspect of the present invention, there is provided an improvement which addresses the stability concerns related to the transition point. When submerging a semi-submersible vessel via ballasting, the point at which the pontoons of a semi-submersible vessel are first completely submerged is known as the transition point. At the transition point, the stability of the vessel is dramatically reduced. Thus, it is desirable to minimize the effects of the transition point and improve the stability of semi-submersible vessels.

The current invention discloses a flared skirt 72 (FIG. 7) along the major axis 52 of the support columns 23, 24, 31 and 32. Flared skirt 72 increases the water plane area at the transition point and, thereby, minimizes the decreased stability which otherwise occurs at the transition point. Stated otherwise, flared skirt 72 acts as a buffer and provides a more stable transition of a semi-submersible to the normal operating draft.

Preferably, the angle defined by the flared skirt 72 and pontoon member 20 or 21 is at an angle from about thirty to sixty degrees. Most preferred, such angle is from about thirty-five to forty-five degrees.

In addition to providing increased stability at the transition point, the flared skirt 72 streamlines the respective intersection of support columns 23, 24, 31 and 32 and pontoons 20 and 21, thereby further reduces hydrodynamic drag. The flared skirt 72 may also be flared along the minor axis 53 of support columns 23, 24, 31 and 32. However, the more preferred embodiment does not include a flared skirt along the minor axis 53 because the added stability at the transition point does not merit the increased hydrodynamic drag created by a flared skirt along minor axis 53.

The invention may be further defined by the dimensions of the semi-submersible vessel which embodies a most preferred design. In a most preferred embodiment, the pontoons 20 and 21 are approximately ninety five meters long, eight meters tall and thirteen meters wide. The support columns 23, 24, 31 and 32 are approximately fourteen meters tall, with a minor axis 53 of nine meters and a major axis 52 of eighteen meters. Preferably, the support columns 23 and 24 and 31 and 32 are transversely spaced forty three meters apart and support columns 24 and 31 and 23 and 32 are longitudinally spaced forty six meters apart. Preferably, the haunches 25, 26, 31 and 33 commence on the support columns 23, 24, 31 and 32 about ten meters above the pontoons 20 and 21 and connect to the horizontal deck 27 at angle. Support columns 23 and 24 are preferably placed sixteen meters behind the bow 71 of, respectively, pontoon 20 or 21. Similarly configured vessels may be optimally defined by ratios similar to those of the components described above and set forth in the figures.

Preferably, the horizontal box 27 is sixty two meters long and fifty seven meters wide. Preferably, the inboard portion of pontoon 20 is approximately 32 meters away from the inboard portion of pontoon 21. Such a configuration allows for the incorporation of preferred living quarters, facilities and equipment shown in FIG. 9. Again, similarly configured vessels may be optimally defined by ratios similar to those of the components described above and set forth in the figures. Further, such a configuration is capable of supporting four thousand tons of variable deck load, abundant thruster power and large fuel, ballast and well product tanks.

The most preferred embodiment also includes a helicopter landing pad (not shown) moon pool 91, living quarters 92, traction winches 94 and medical facilities 95. Preferably, noise generating equipment 96 is located at the stern end of the vessel and living quarter 92 are located at the bow end of the vessel to provide more comfortable accommodations for crew members.

Loading

In another aspect of the present invention, there is provided an improved method for underslinging loads from a semi-submersible vessel. Because the vessel which embodies the current invention does not include horizontal or diagonal cross bracing, a barge (not shown) or other vessel may be placed directly under the moon pool 91 of the semi-submersible vessel. Cranes, winches, derricks and similar devices may drop a line (not shown) directly to the load. Because such a method does not require a separate lift vessel or use of keel hauling, greater loads can be more effectively handled. Examples of such handling include, raising a load, such as a well template, which can then be transported in an underslung position to an offshore site and then installed by the current invention.

Referring now to FIGS. 12–17, preferred methods for using the semi-submersible vessel disclosed herein may be better understood.

Loading Time

A significant percentage of time and costs associated with installation and construction services offshore are embedded in "loading" time. As used herein, loading time includes time associated with waiting for weather, actual loading time for spooling product and transport of product to an installation, construction or decommission site. As used herein, product refers to any product which is spooled and used in connection with installation, construction or decommission ongoing services. Examples of product include pipe, umbilical, casing, conductors and synthetic rope. Loading time varies from vessel to vessel and project to project, but may be as high as sixty percent (60%) of a vessels useable service time. The present invention discloses improved methods for loading, installing and reloading product which minimize the need for loading time. The present invention provides a vessel which maximizes service time by reducing or transferring loading and de-loading time from the semi-submersible vessel to other equipment such as transport vessels.

A semi-submersible vessel is ultimately a services vessel. Fees are typically billed on either a project or service day fee. By decreasing loading time, the time it takes for a semi-submersible vessel to complete any given project is reduced. By reducing project time, a project may be completed in a reduced time period and many additional projects may be undertaken. Stated otherwise, the reduction in project time decreases project costs and increase useable service time and potential profit. Methods and devices which reduce project time are highly desirable. Additionally, loaded product may weigh as much as 2,400 tons. Accordingly, new methods and devices that provide safe and reliable ways to load semi-submersible vessels without undue risk of collision or significant increases in moment forces are highly desirable.

Transport Vessel

Figure 13A:
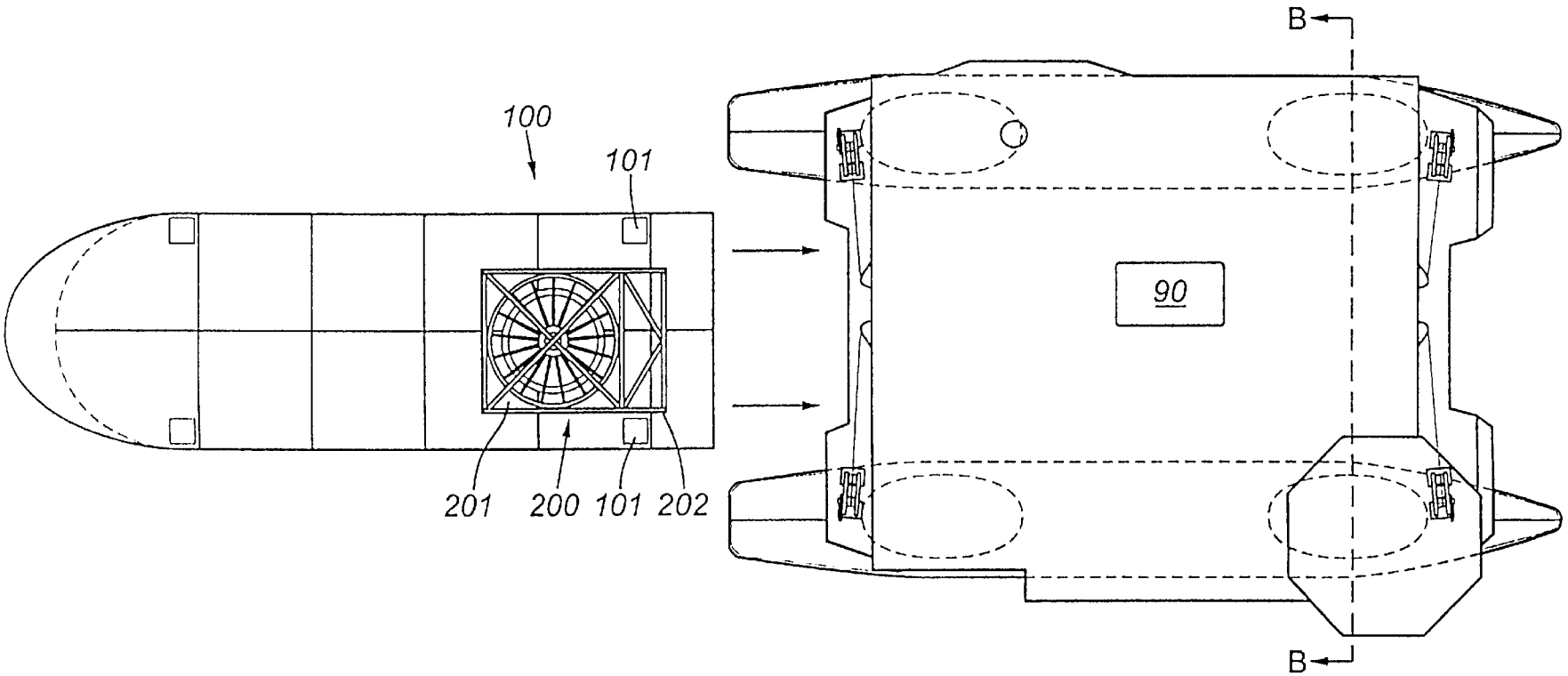
Figure 13B:
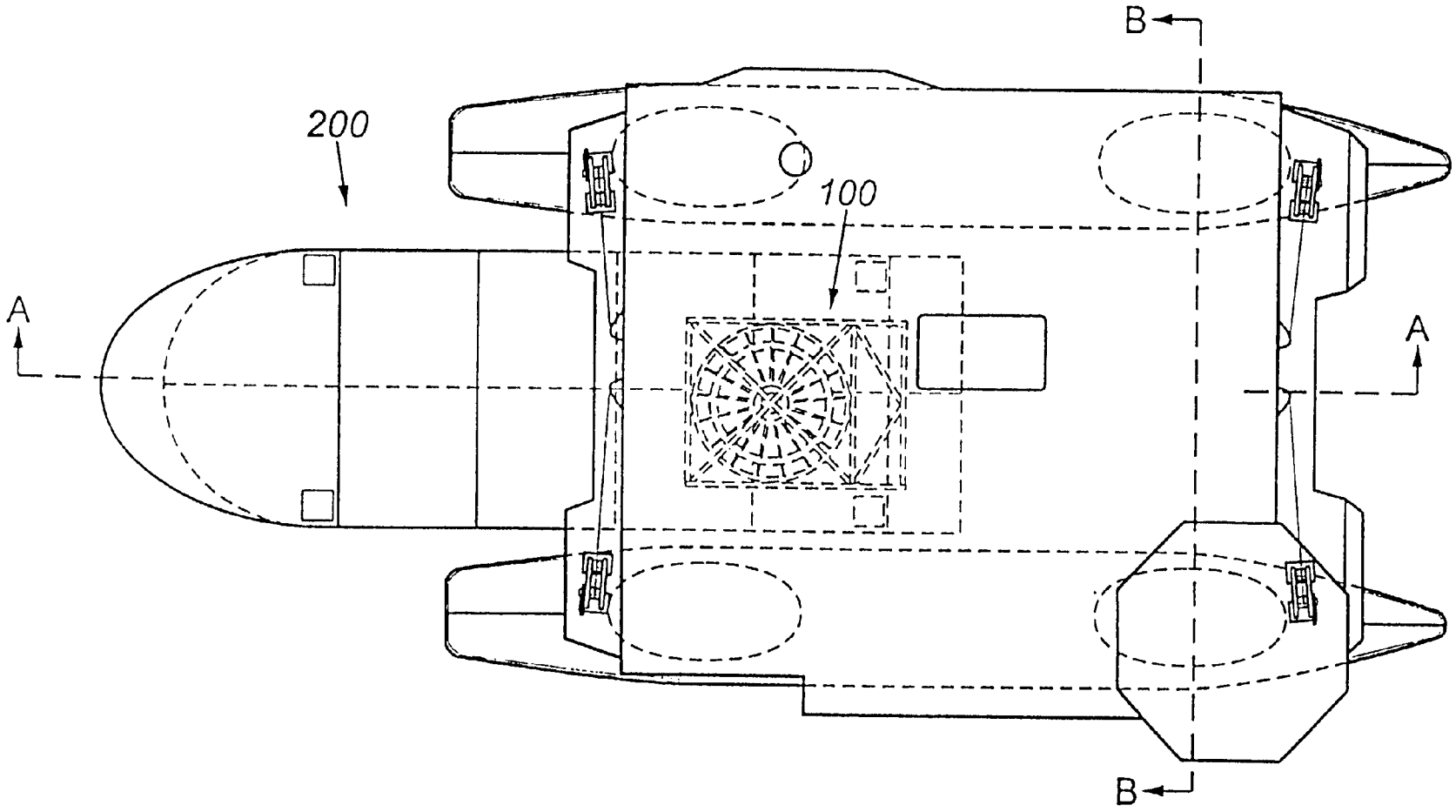
Figure 13C:
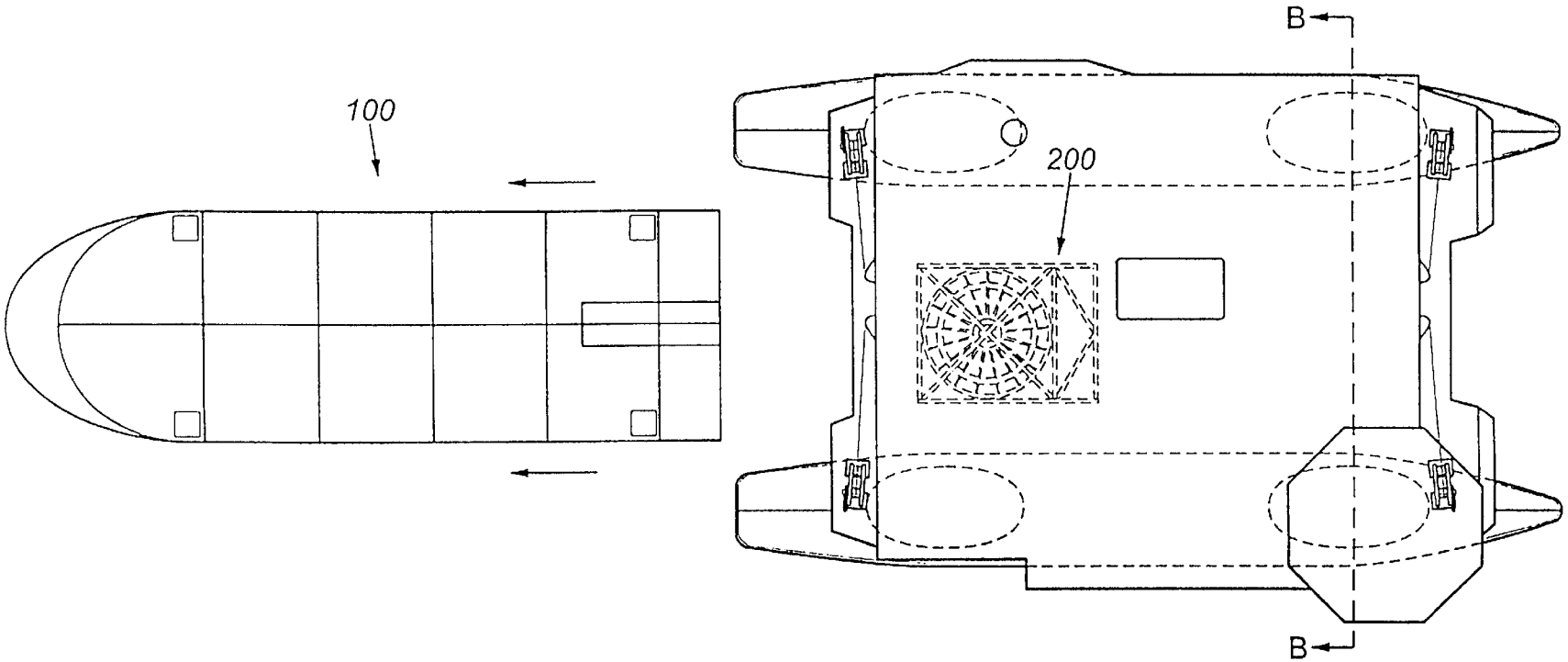
Figure 13D:
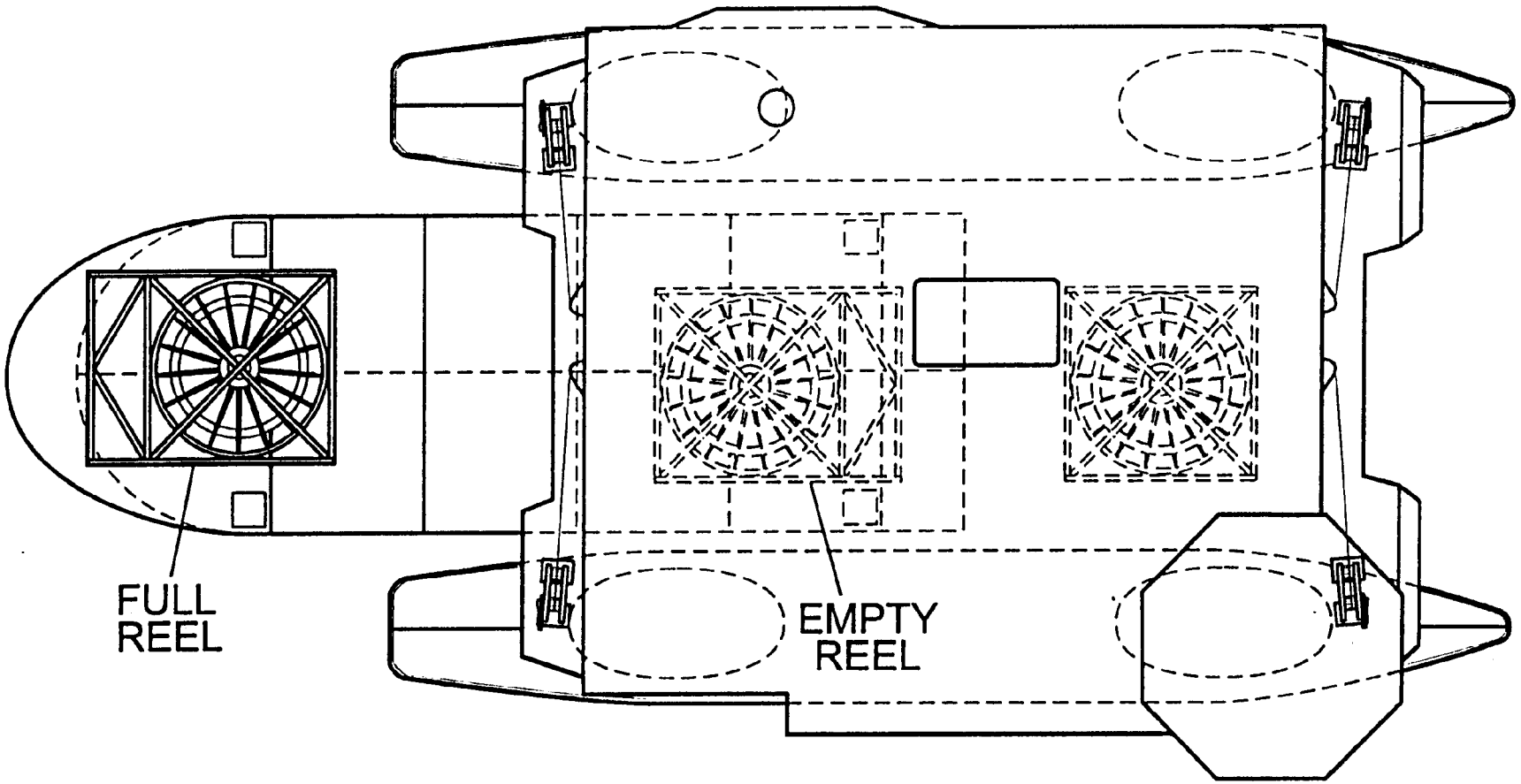
Figure 13F:
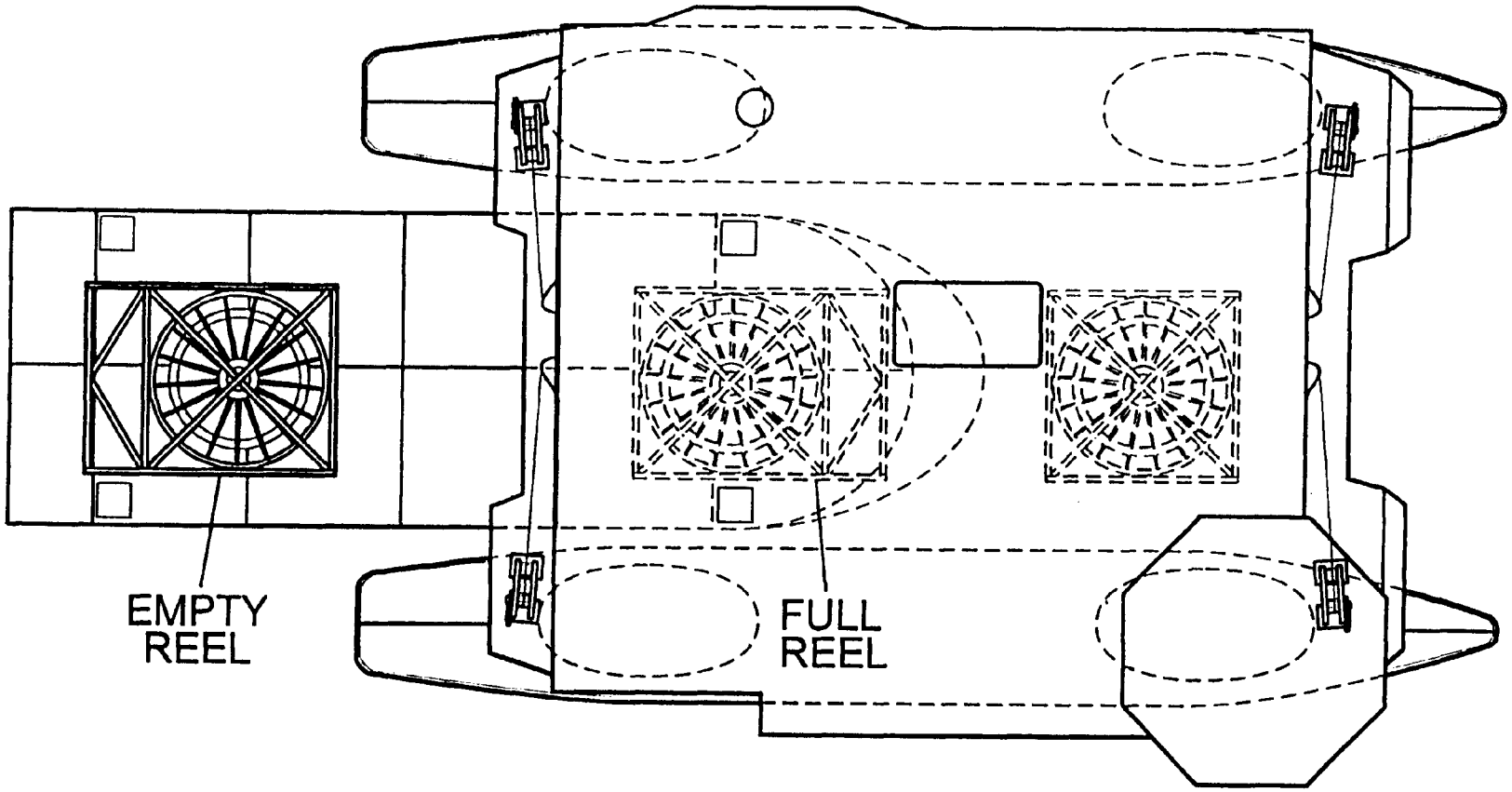
Figure 13G:
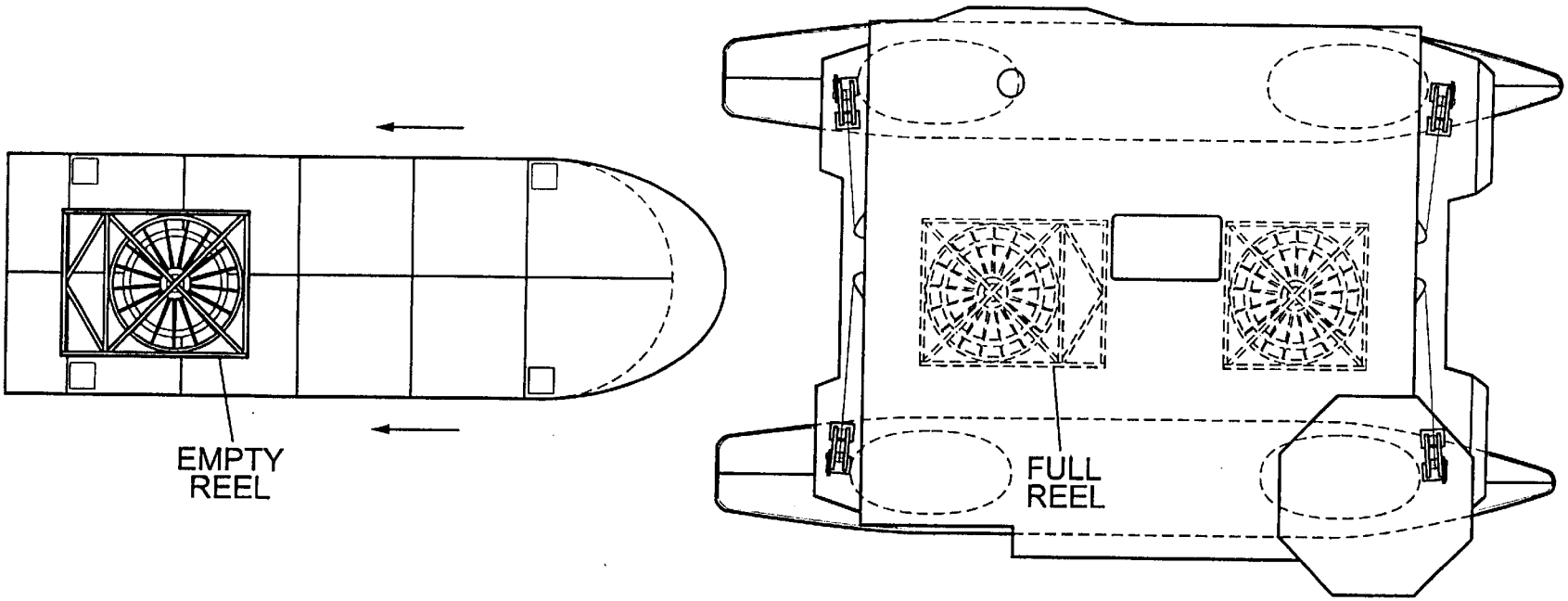
Figure 14A:
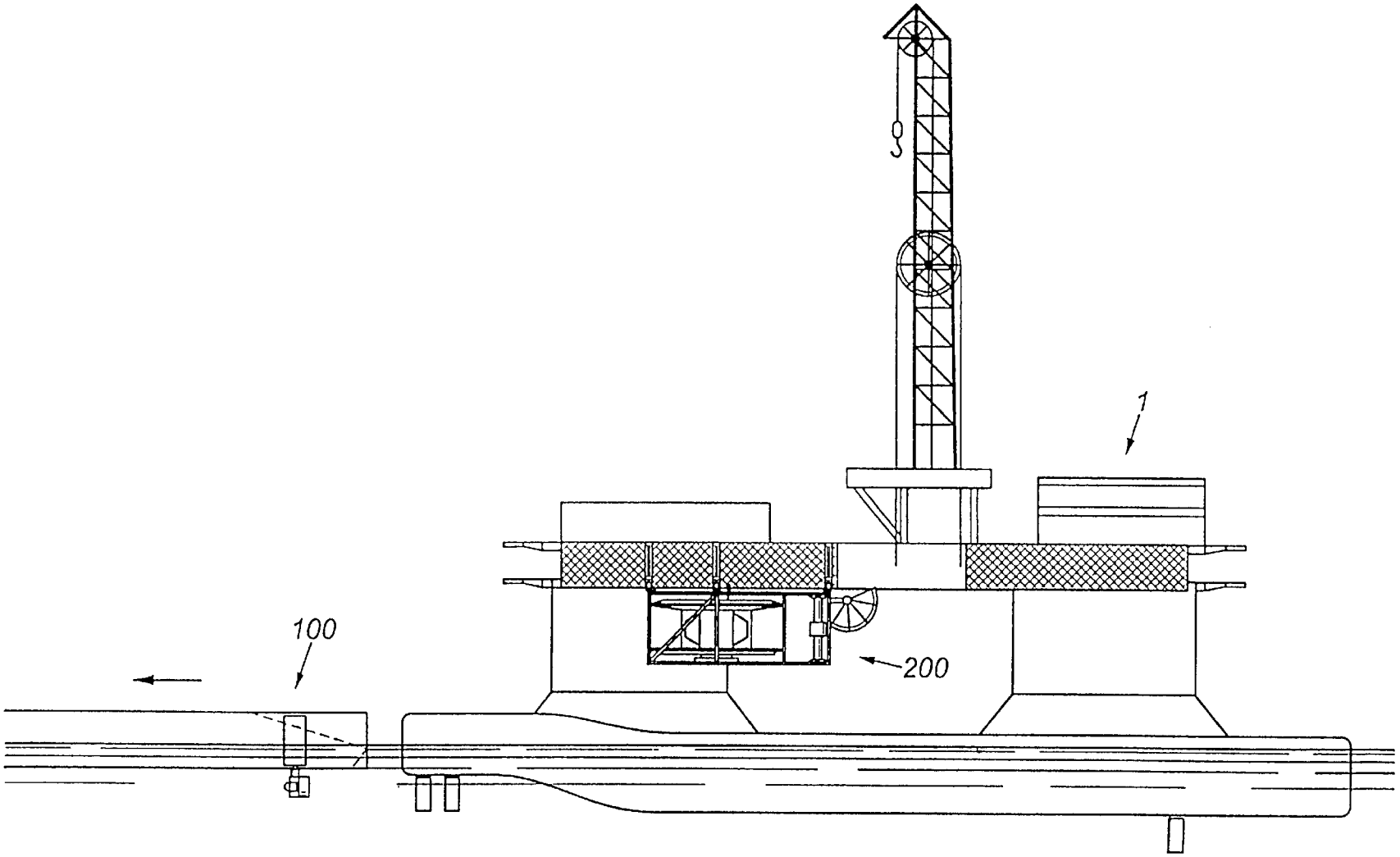
FIGS. 14*a* and 14*b* are side views of the semi-submersible vessel of FIG. 2, which illustrates loading of and an underside loaded product.
Figure 14B:
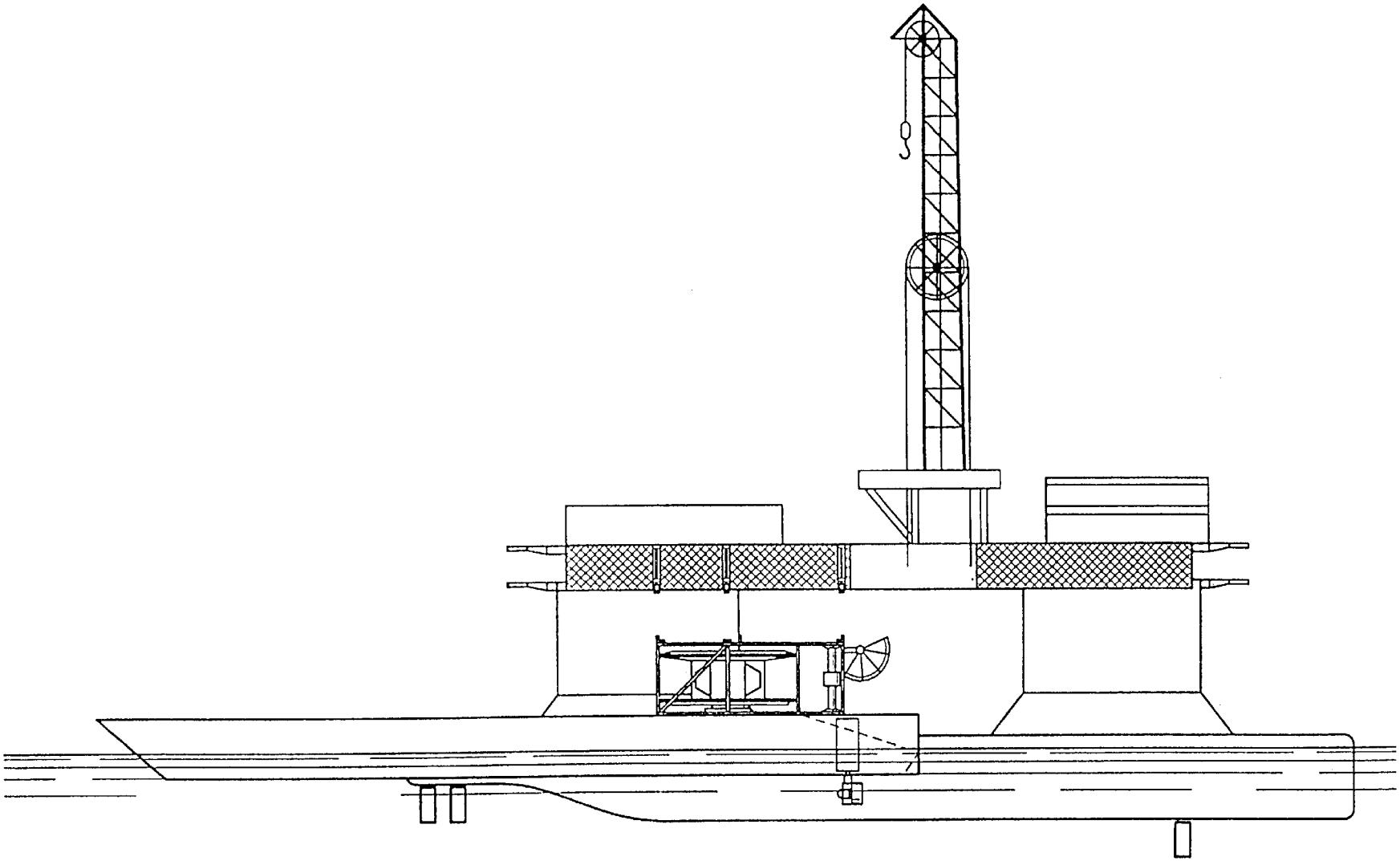

As shown in FIGS. 13*a*, 13*b* and 13*c*, the absence of cross bracing on semi-submersible vessel 1 allows for the positioning of transport vessel 200 and its associated product 200 underneath semi-submersible vessel 1. In a preferred embodiment, a transport vessel 100 is used for loading and reloading the semi-submersible vessel 1. The transport vessel 100 may be docked and loaded with product in manners well known to those skilled in the art. Once loaded, the transport vessel may travel to the semi-submersible vessel 1 located offshore. Because a transport vessel is relatively immune to weather restrictions when compared to a semi-submersible vessel, the elimination of weather from loading time significantly decreases overall loading time and costs.

Many design challenges are associated with the safe positioning of transport vessel 100 underneath semi-submersible vessel 1. In particular the proper alignment and positioning of vessel 1 prior to and during the actual loading process are highly important. In order to overcome this design challenge, the preferred transport vessel includes alignment monitors 101 which control associated thrusters 102. A particularly preferred alignment monitor is a laser, although additional devices such as spring loaded hydraulic cylinders, physical guides and bumpers including roller bearings may be used. In operation, as the transport vessel 100, travels under semi-submersible vessel 1, while alignment monitors 101 continually monitor the location of pontoons 20 and 21 and columns 23, 24, 31 and 32 alignment monitors 101 control associated thrusters 102. By monitoring relative positions, an alignment monitor 101 may maintain safe clearance by compensating speed or direction of transport vessel 100 by increasing or decreasing power from its associated thruster 102.

Preferably, semi-submersible vessel 1 also includes a reference source 90. Suitable reference sources 90 include laser generators, radio generators and normal docking mechanisms including mooring devices which may provide an additional reference point to alignment monitors 101. In addition to preventing possible collisions between the semi-submersible vessel 1 and transport vessel 200, the combined reference source 90 and alignment monitor 101 allow for proper alignment of product 200 with product loaders 300.

Figure 15A:
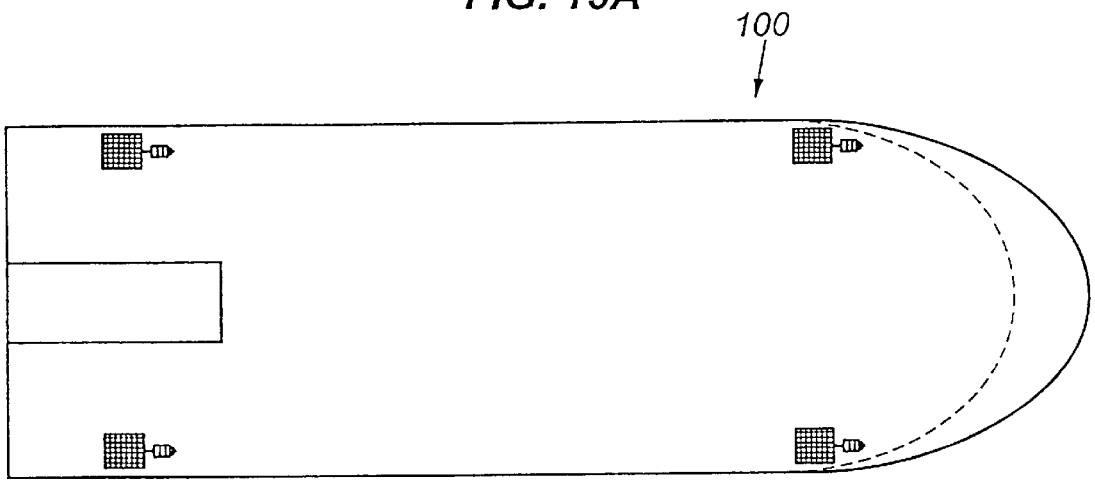
FIGS. 15*a*, 15*b*, 15*c*, 15*d*, 15*e* and 15*f* are views of a preferred product carrying vessel.
Figure 15B:
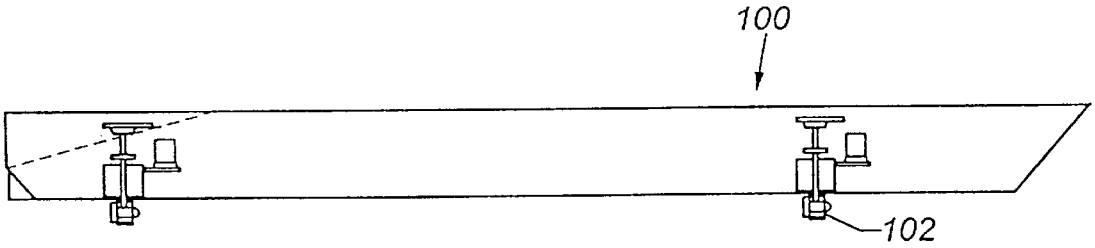
Figure 15C:
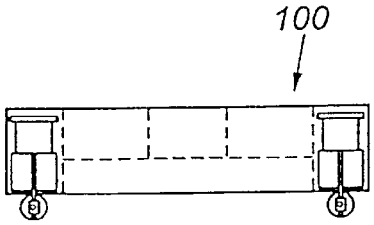
Figure 15D:
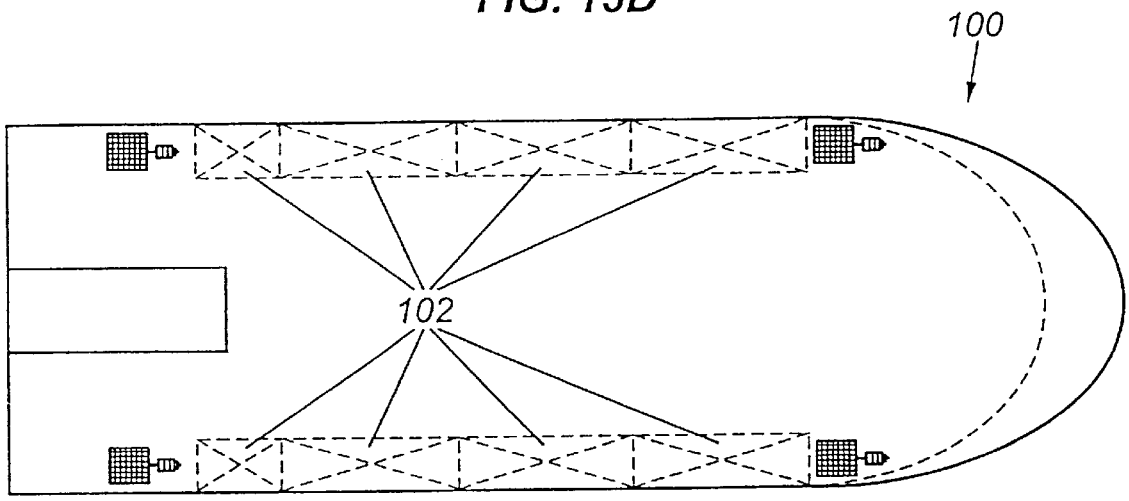
Figure 15E:
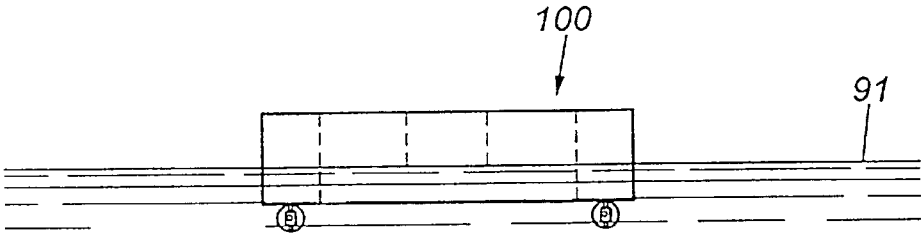
Figure 15F:
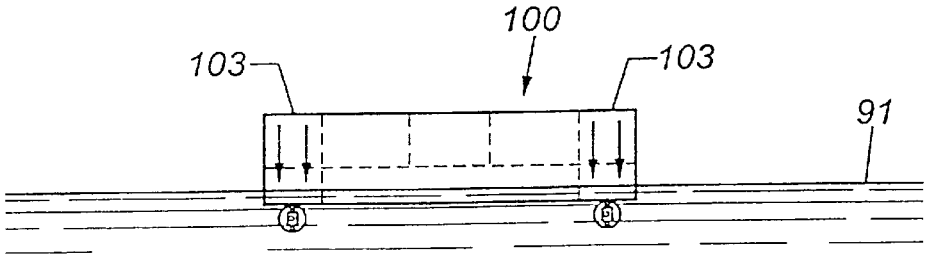
Figure 16A:
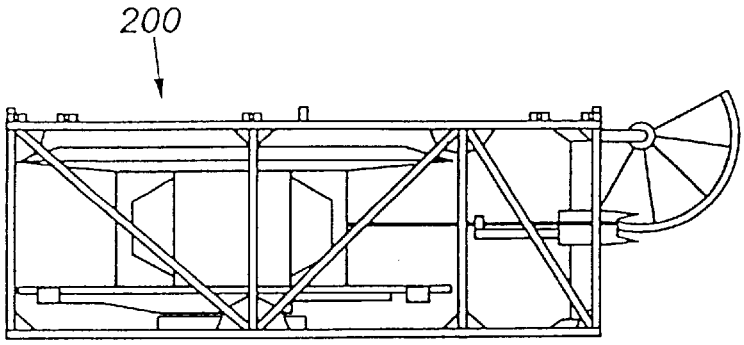
FIGS. 16*a*, 16*b* and 16*c* are a series of views of the preferred reel and cassette apparatus.
Figure 16B:
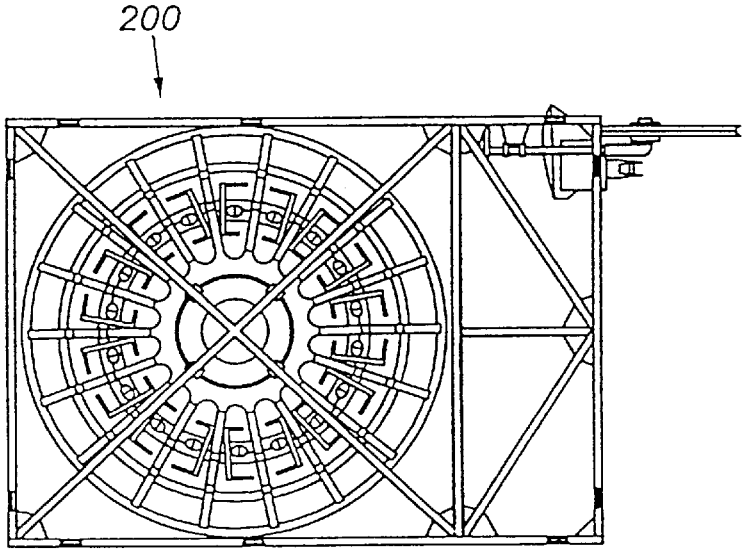
Figure 16C:
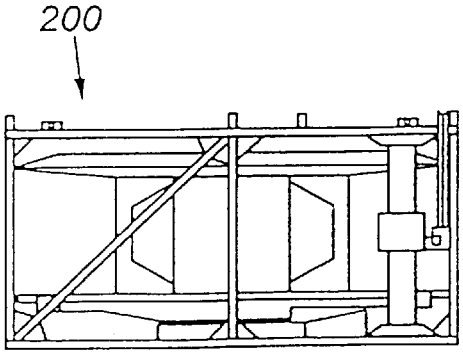
Figure 17:
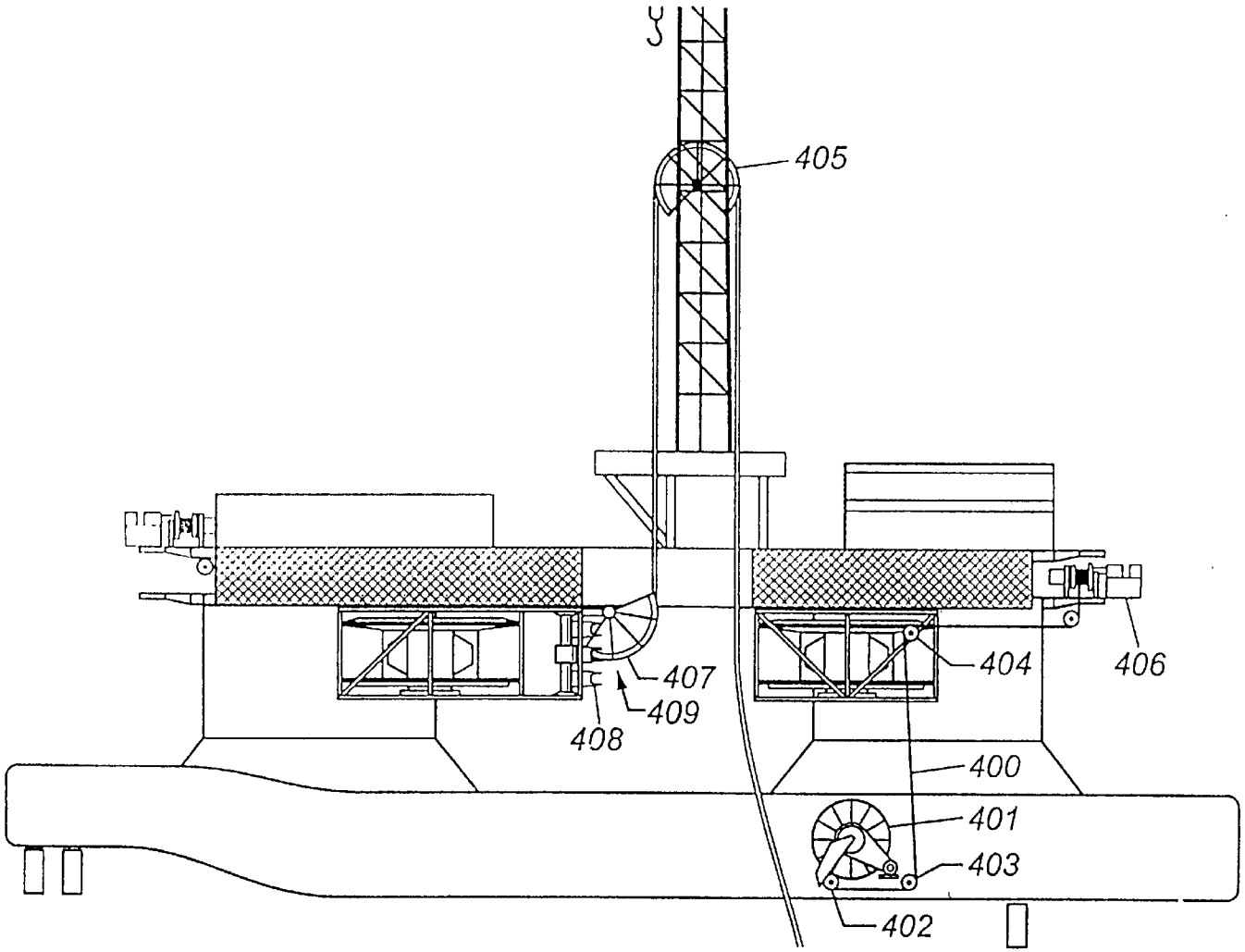
FIG. 17 is a side view of the semi-submersible vessel of FIG. 2, which illustrates installation of product.
Figure 18:
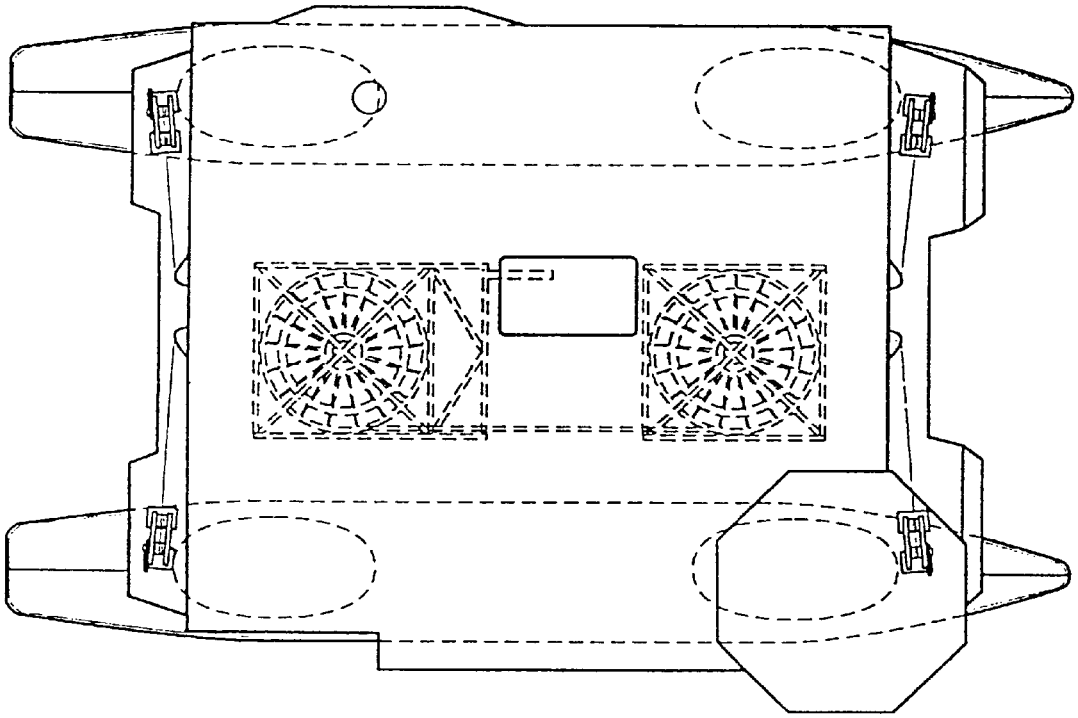
FIG. 18 is a top view of the semi-submersible vessel of FIG. 2, which illustrates a dual-loaded underside.
Figure 19A:
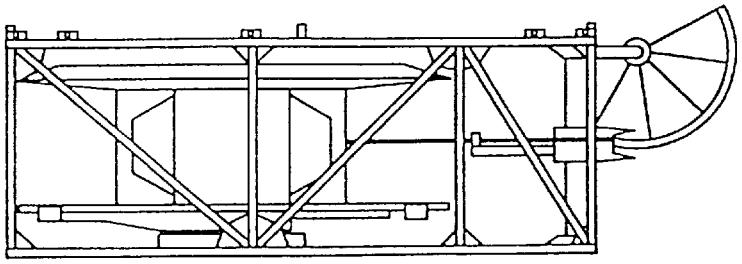
FIGS. 19*a*, 19*b* and 19*c* are various views of a preferred reel and cassette device.
Figure 19B:
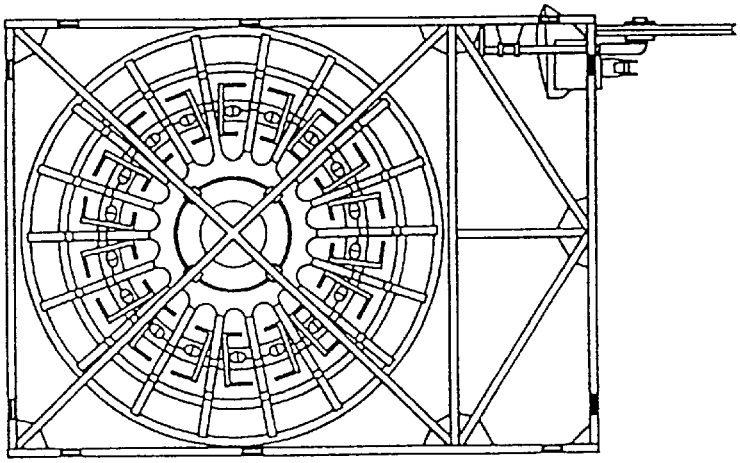
Figure 19C:
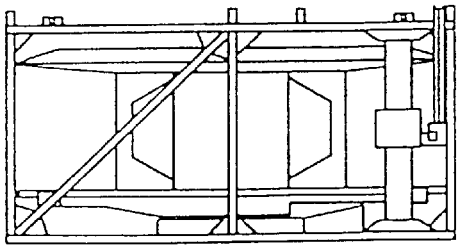
Figure 20A:
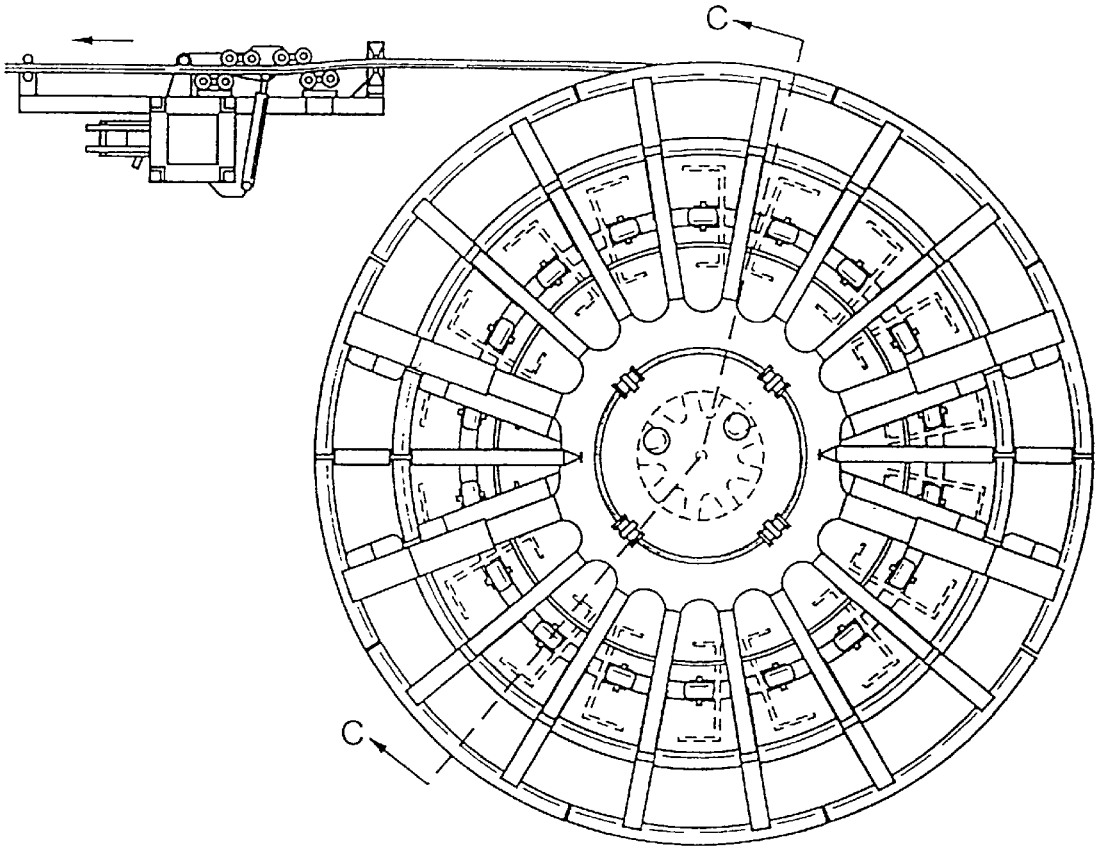
FIG. 20 is a series of views of the preferred real of FIG. 19.
Figure 20B:
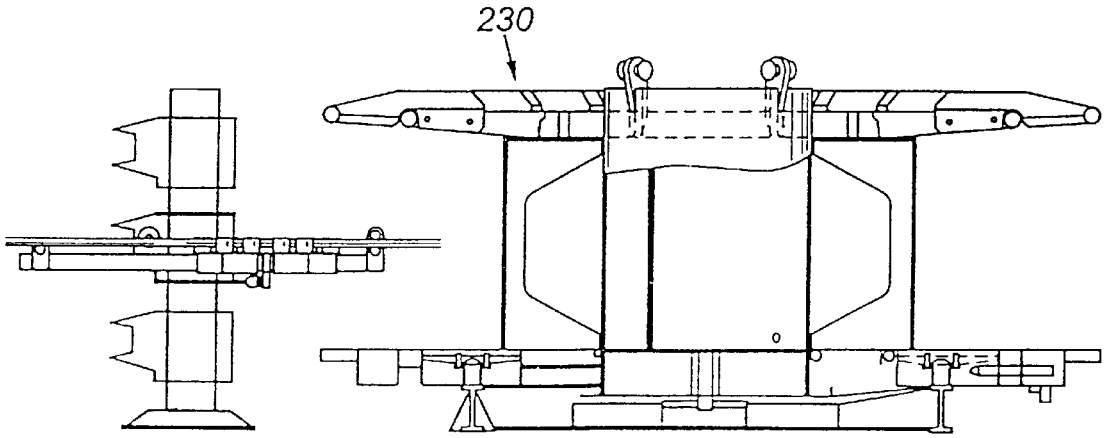
Figure 20C:
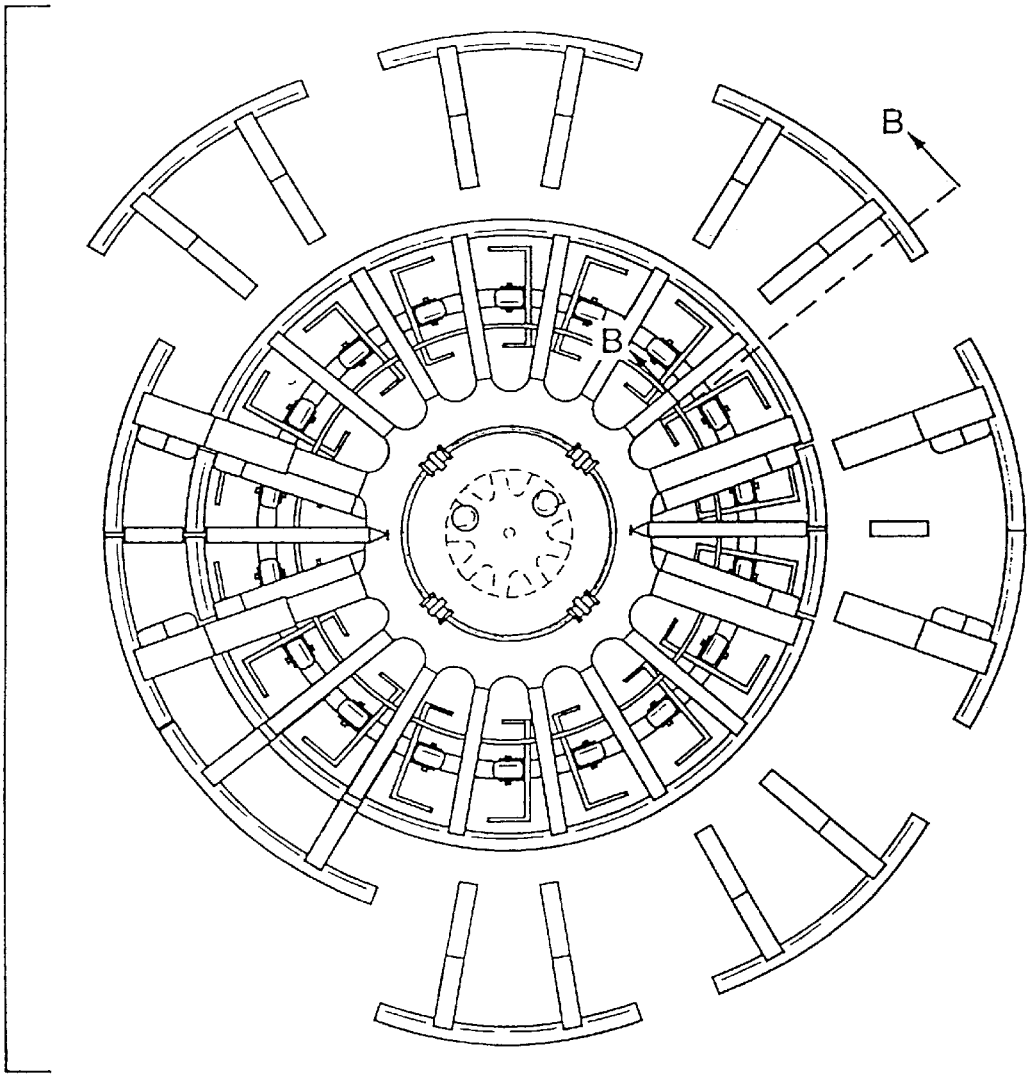
Figure 20D:
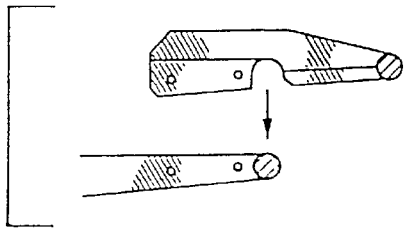
Figure 20E:
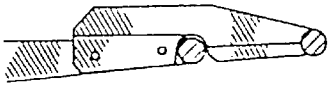
Figure 20F:
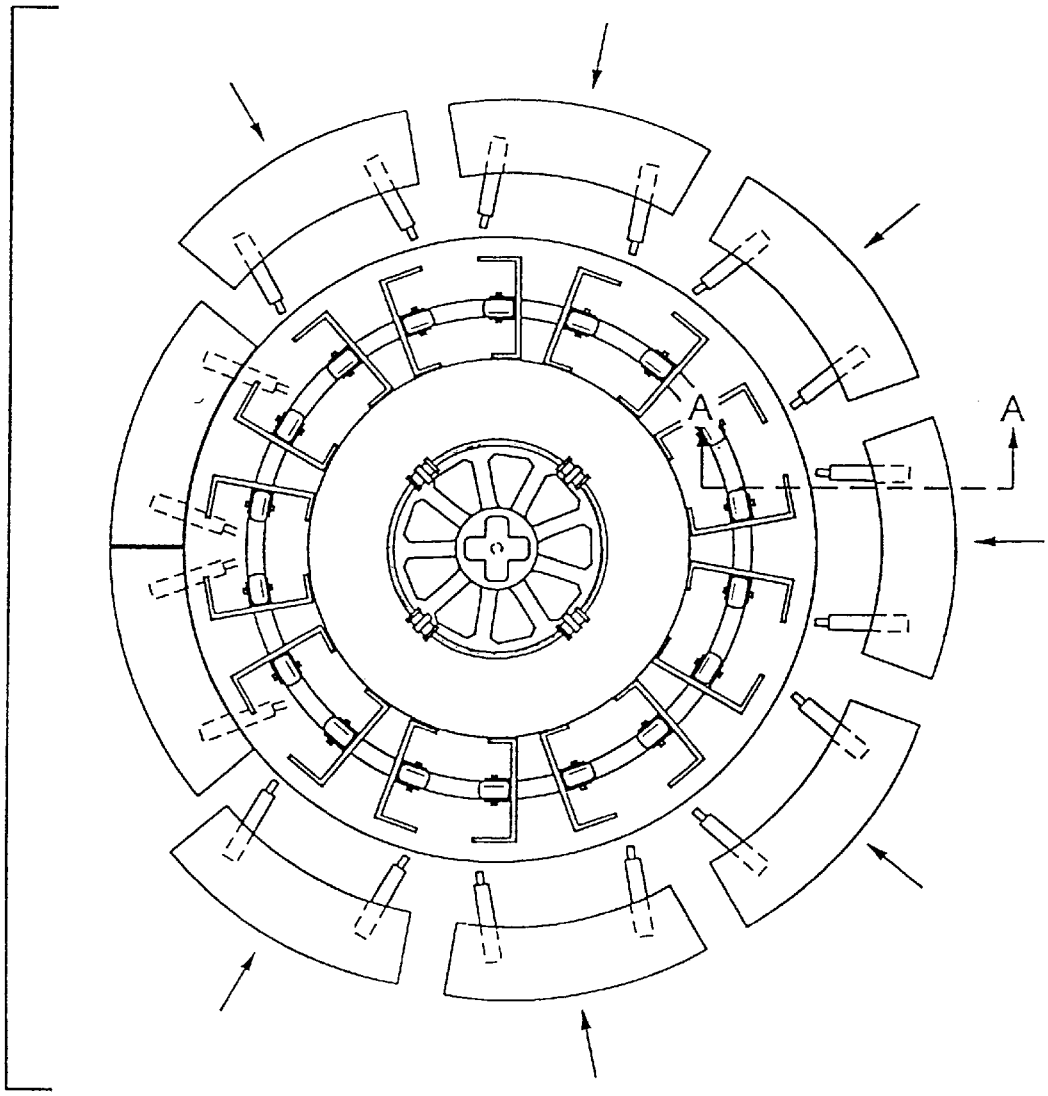
Figure 20G:
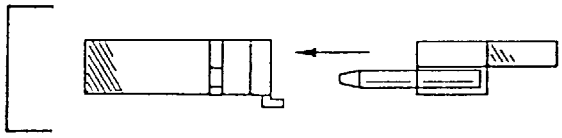
Figure 20H:
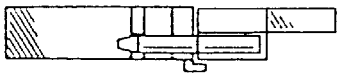
Figure 21A:
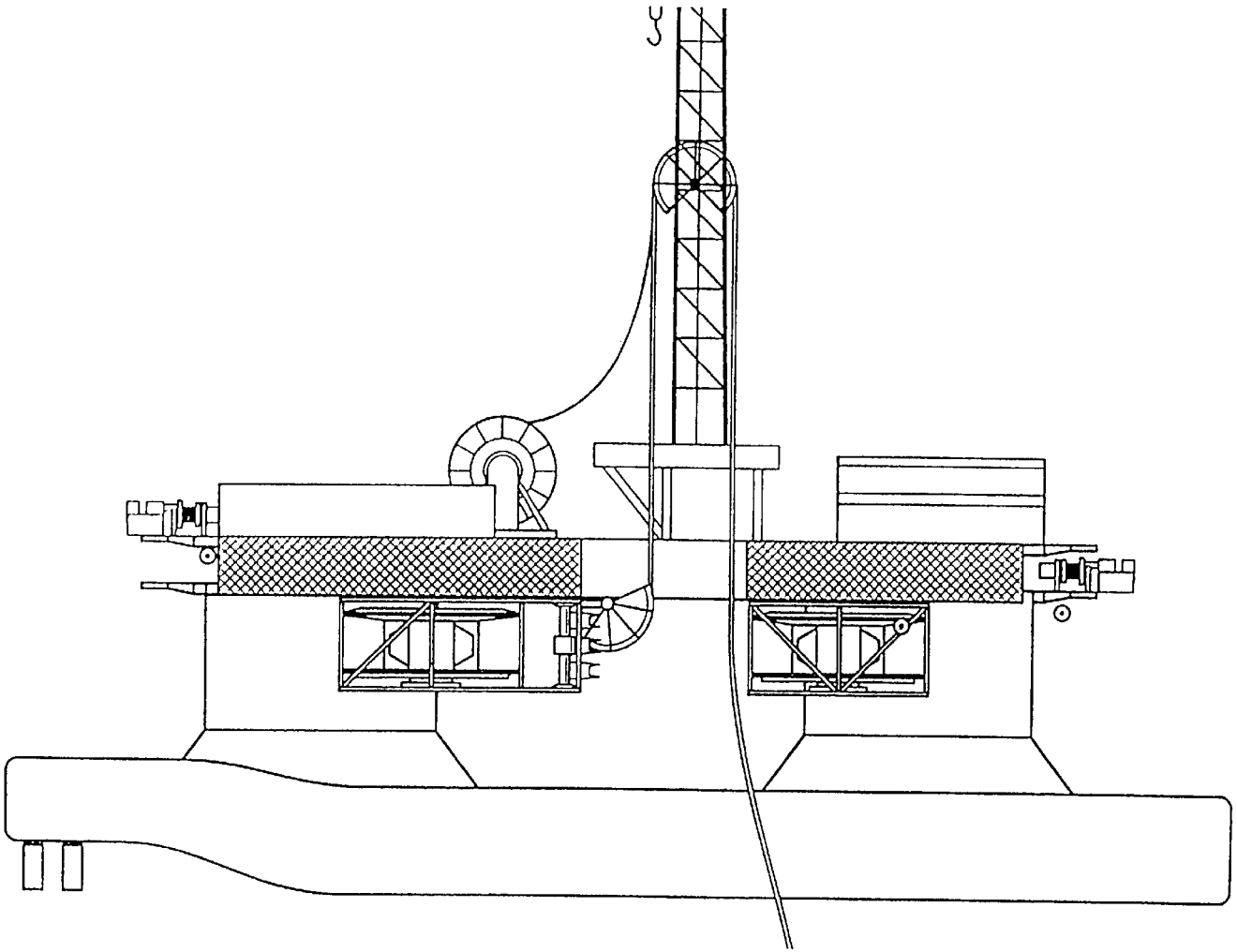
FIGS. 21*a*, 21*b*, 21*c* and 21*d*–21*g* are varies views of the vessel of FIG. 2, which illustrate installation of product.
Figure 21B:
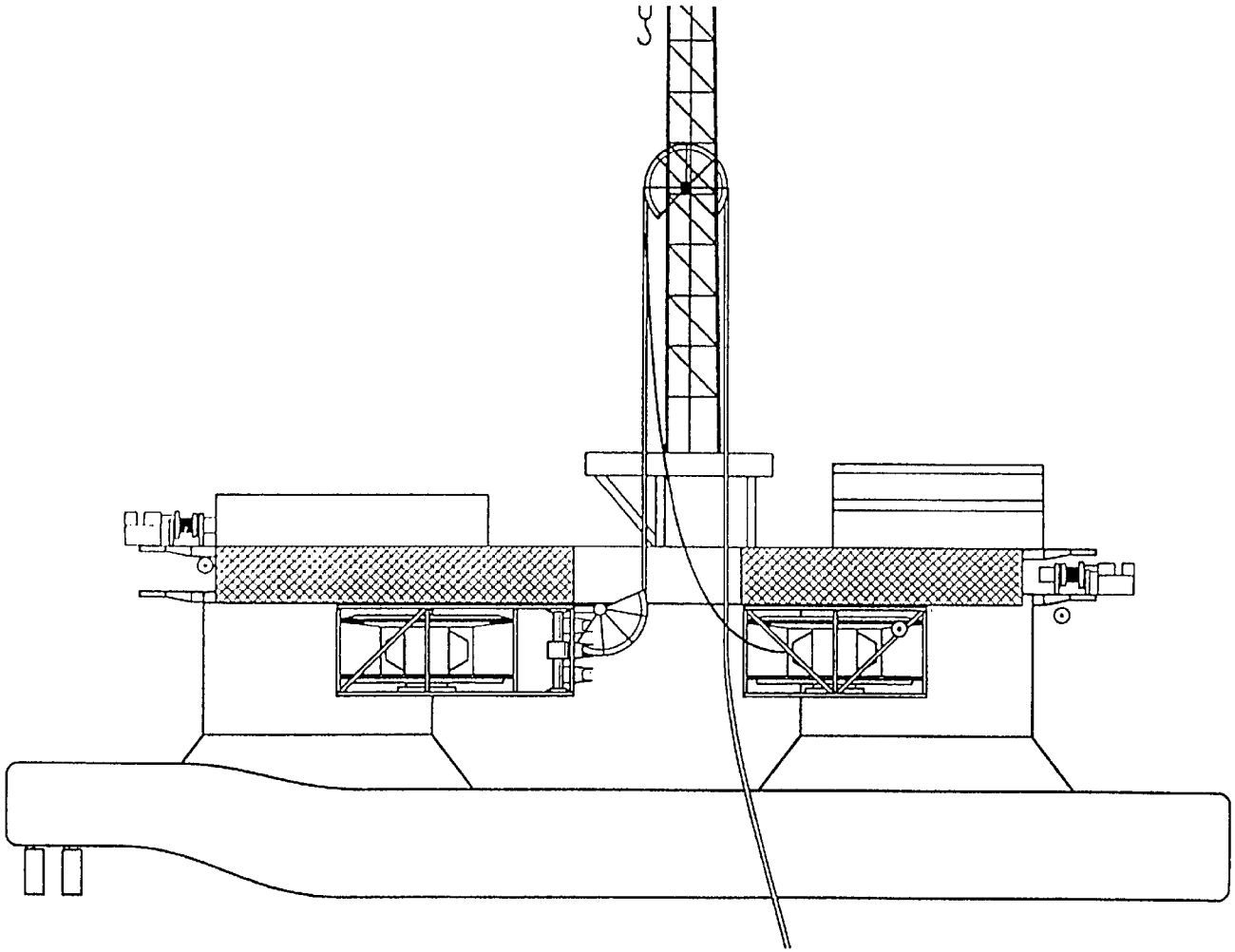
Figure 21C:
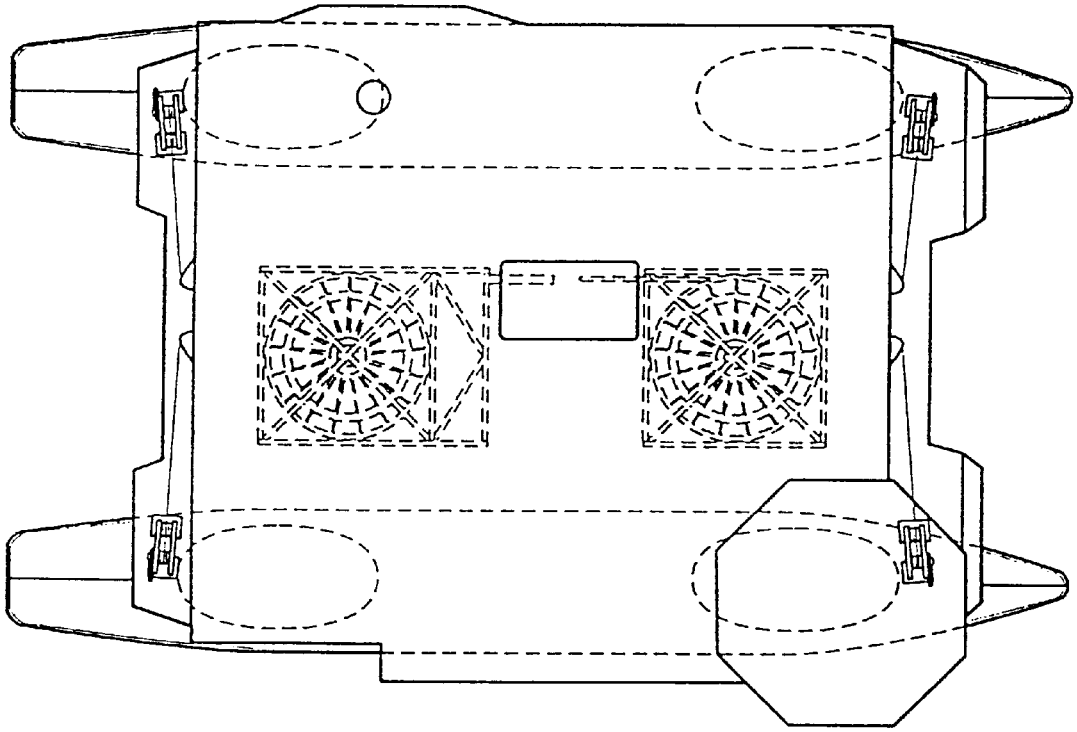
Figure 21D:
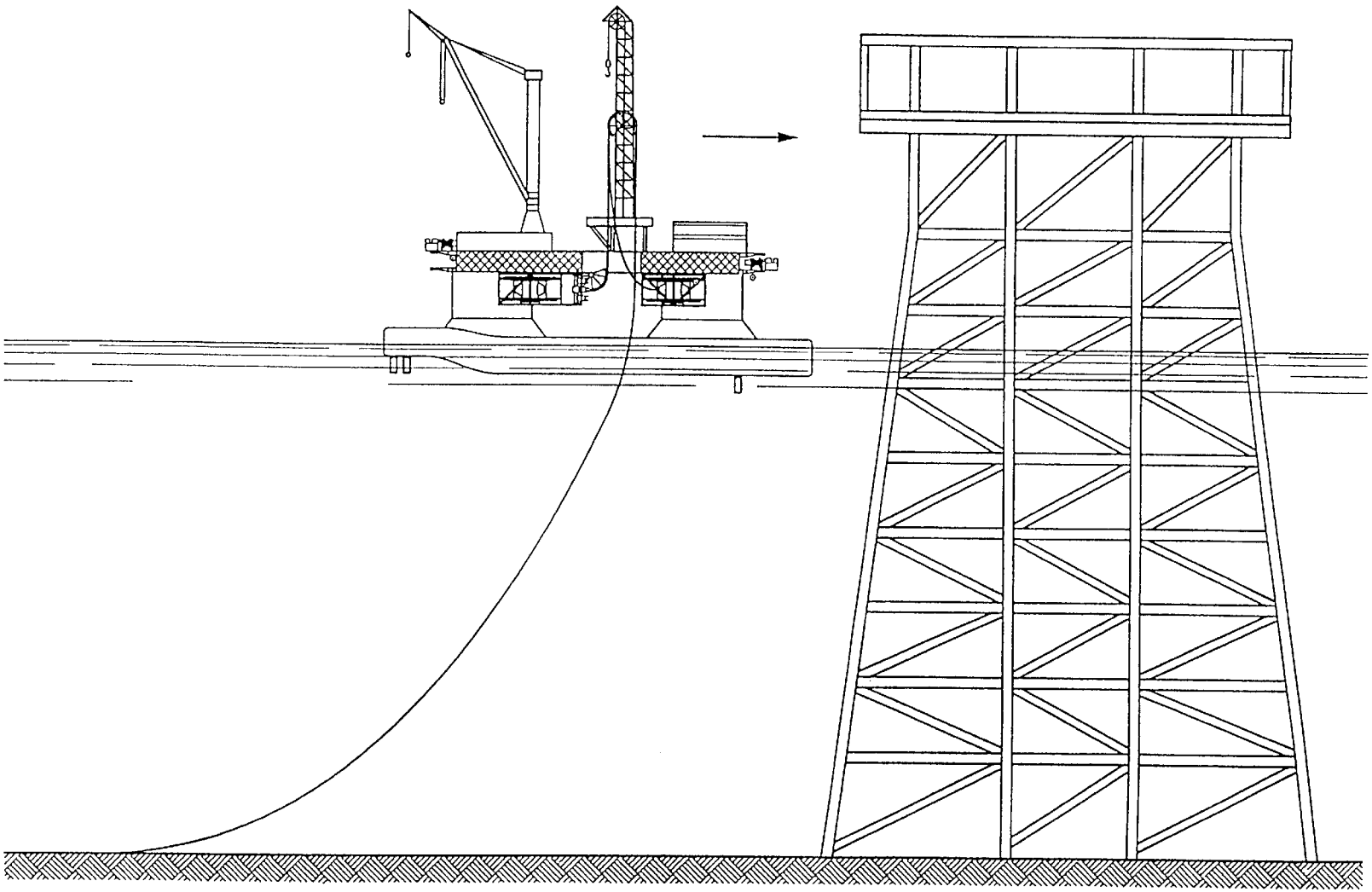
Figure 21E:
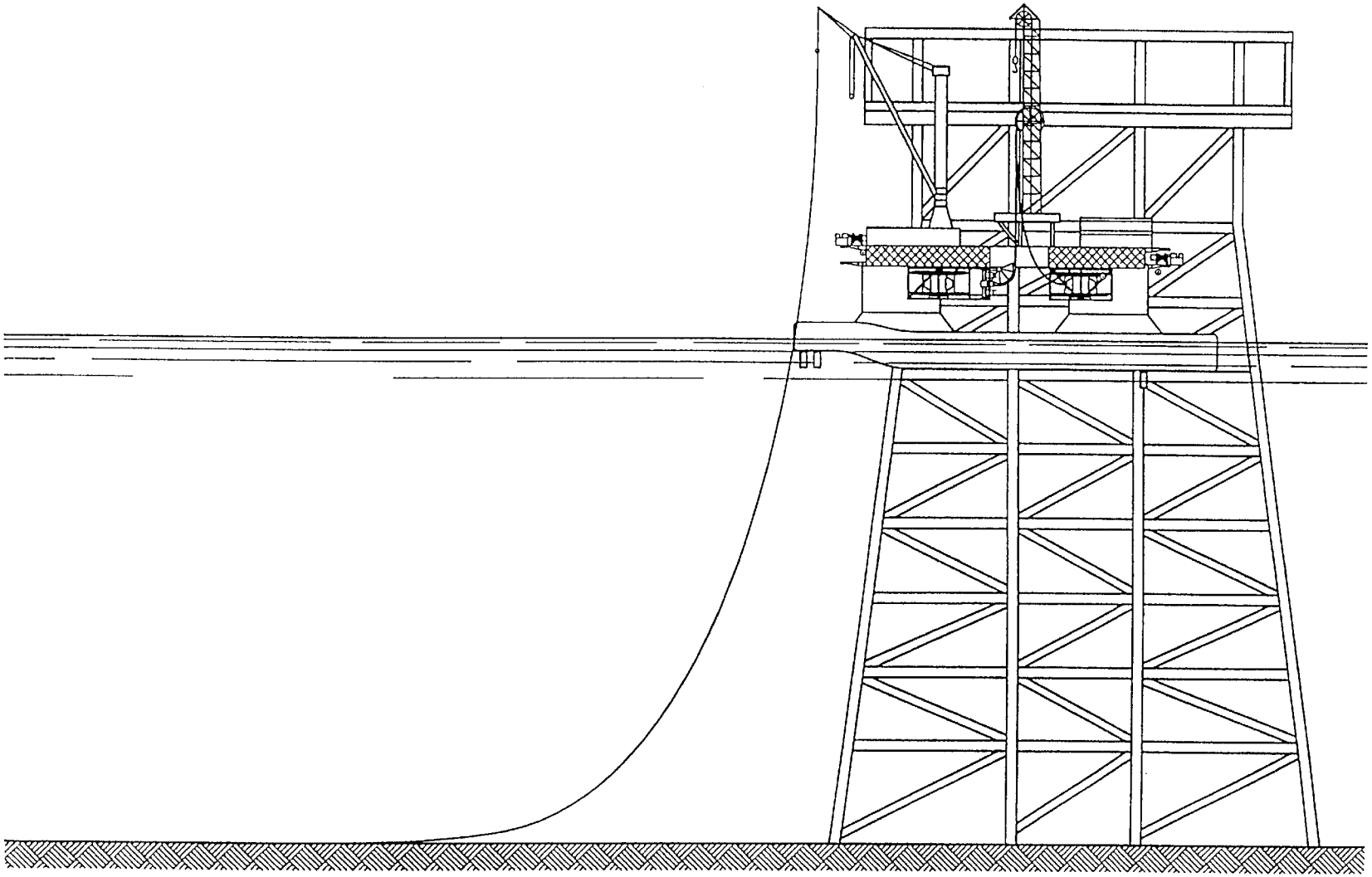
Figure 21F:
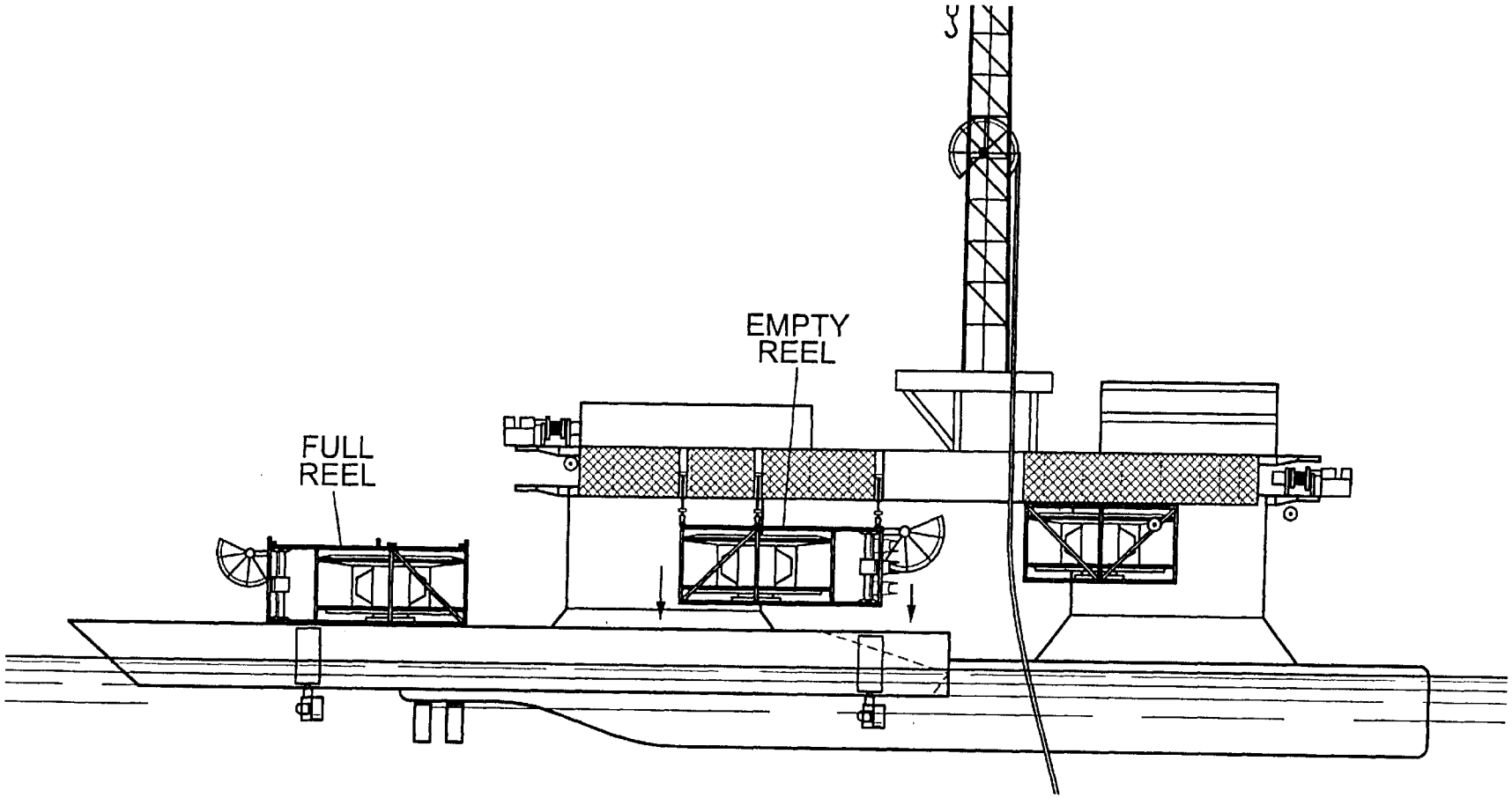
Figure 21G:
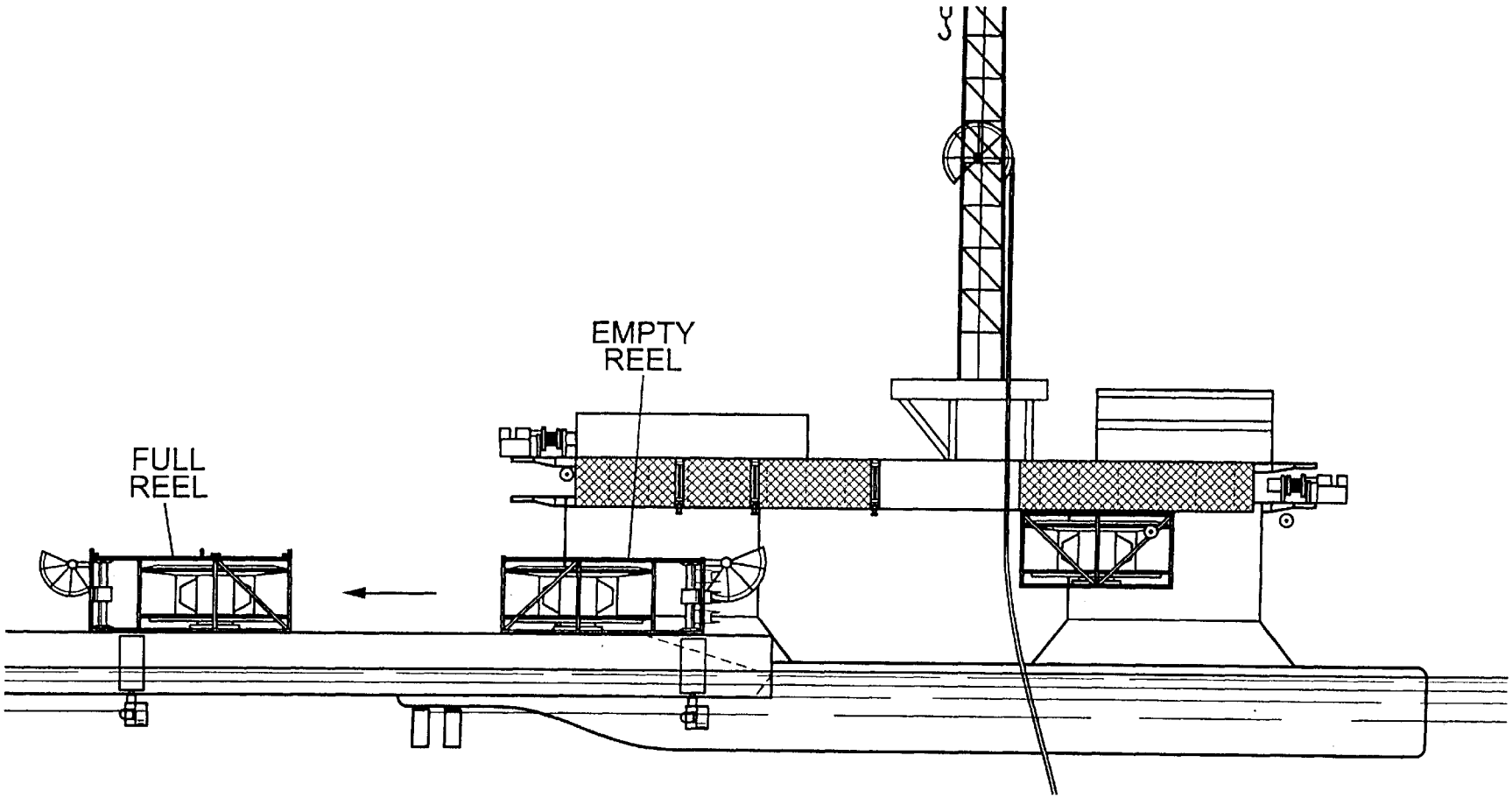

Other design challenges relate to the stability of transport vessel 100. As discussed above, product may weigh as much as 2,400 tons. Accordingly, when the product is raised onto and from transport vessel 100, transport vessel 100 is subject to significant motion and inertical, sea, structural and loading forces. In order to minimize such forces, the preferred transport vessel includes motion suppression tanks 102. Preferably, motion suppression tanks 102 are located on both port and starboard sides of transport vessel 100. A particularly preferred suppression tank utilizes high volume low pressure compressor units. As illustrated in FIGS. 15E and 15F, accusation of compressor units (not shown) increases the pressure within motion suppression tanks 102 creating displacement force 103, which effectively displaces water from motion suppression tanks 102 and causes transport vessel 100 to be "air lifted" with reference to water plane 91.

In a most preferred embodiment, transport vessel 100 includes active control devices such as a pneumatic valve control panel (Not shown), which continually monitor and maintain the position of transport vessel 100 relative to water plane 91 by actuating and de-actuating compressor units. For example, as product is gradually unloaded from transport vessel 100 as described below, the total weight and associated water displacement of transport vessel 100 is decreased. In order to maintain the positioning of transport vessel 100, control devices may cause compressor units to decrease displacement force 103, thereby maintaining the equilibrium transport vessel 100 by maintaining the total net forces from water plane 91, total weight and displacement force 103.

Product Loading

Referring now to FIGS. 12A, 12B, 12C, 12D, 14A and 14B, the loading of product 200 from transport vessel 100 onto the underside of semi-submersible vessel 1 may be better understood.

Once the transport vessel 100 is properly positioned under the product loaders 300, the loading of product 200 may commence. Preferably, product loaders 300 are either vertical hydraulic cylinders or chain jacks. Chain jacks are highly efficient; relatively inexpensive and well suited for gradually raising product 200. Suitable alternatives to hydraulic cylinders and chain jacks are known to those skilled in the art to include linear pullers, traction wenches and ballasting the vessels to meet each other.

A female receptacle 302 may be attached to the end of chain jack 301 and lowered towards product 200. Preferably, product 200 is loaded on reel 201 and positioned in cassette 202. Female receptacle 302 engages adapted male member 303. Once engaged, female receptacle 302 is secured to male member 303 with locking pin 304. Of course, the respective positioning of female receptacle 302 and male member 303 may be reversed. Alternatives to the male/female combination are well known to those skilled in the art and include hook and loop and rails, guides and shackles.

Once engaged, reel 201 and cassette 202 are gradually raised upwardly toward the underside of semi-submersible vessel 1, fastening device 305 and an associated interlock (not shown) are then aligned and engaged such that reel 201 and cassette 202 are secured to the underside of semi-submersible vessel 1.

Preferably, reel and cassette 200 includes spindle 04, and a semi-submersible vessel 1 and includes a corresponding receptacle. The spindle 204 acts as a stabbing point, which may be secured by internal hydraulic locking pins (not shown). The spindle 204 and corresponding receptacle provides additional alignment and securing support.

The method described herein is well suited to loading a variety of apparatus to the underside of a semi-submersible vessel such as reels, sub-sea template and manifold protection houses.

Installation

Referring now to FIGS. 14*a*, 16*a*, 16*b*, 16*c*, 17 and 18, a method for installing product from underside loaded product may be better understood.

Lead line 400 is attached to winch 406. Lead line 400 travels from winch 406 to a turning sheave onto pulley 405 to the reel and cassette system 200.

Once product is attached to lead line 400, the force of winch 406 gradually unspools product from reel 401 through alignment device 409 and about main pulley 405. Once product is about main pulley 405, product may be associated with a deadweight and gradually installed in a manner well known to those skilled in the art.

Alignment device preferably includes a pulley 407 and feed apparatus 408, whereby product is continually fed without undue stress.

Semi-submersible vessel 1 and the described method is well suited for continuous installation of product. The derrick may be attached to product being loaded from reel and cassette 200. The derrick may be used to maintain product, in a constant position. A second spool of product may then be loaded form reel and cassette 420. Product fed from reel and cassette 420 may be aligned with product fed from reel and cassette 200 and secured together by welding or other ways well known in the art. Once secured, product may continue to be installed.

Air Support

The frictional force caused by the turning of reel and cassette 200 at interface 220 is relatively high. Such frictional force may cause failures if bearings or other typical devices are used at intersection 220. In order to reduce failures, the preferred embodiment of reel and cassette 200 incorporates an air cushion at interface 220.

An air cushion may be created by compressors and other ways well known to those skilled in the art. The effective force of the air cushion must be greater than the combined weight of the reel and, its associated product distributed over the surface area of base 221 and reel 201.

At times, it is desirable to simultaneously install two different products. Two different products may be simultaneously installed with the present invention by first loading product from reel and cassette 200 and then securing product with a derrick as described above. A second spool of product may then be loaded from reel and cassette 420. Product fed from reel and cassette 420 may be associated with product fed from reel and cassette 200 by technologies such as welding. Once the respective products use associated, they may be simultaneously installed by securing a dead weight and lowering the same into the installation site. Of course, the deadweight may be secured before the respective products are associated.

Adaptable Reel

Preferably reel 201 has an adaptable diameter as shown in FIG. 20. The adaptable diameter allows reel 201 to be used with a variety of cassettes and applications.

The present invention, therefore, is well adapted to carrying out the objectives and obtain the ends and advantages mentioned, as well as others inherent herein. All presently preferred embodiments of the invention have been given for the purposes of disclosure. Numerous changes in the detail of construction may be made which will readily suggest themselves to those skilled in the art and which are encompassed within the spirit of the invention and the scope of appended claims.

What is claimed is:

1. A method for loading a semi-submersible vessel having an underside comprising the steps of:

providing a reel that is loaded with product;

positioning said loaded reel under said semi-submersible vessel;

connecting a lifter means to said loaded reel for raising said loaded reel;

lifting said loaded reel toward said underside of said semi-submersible vessel; and engaging a fastener means with said loaded reel to secure said loaded reel to said underside of said semi-submersible vessel.

2. The method of claim 1, further comprising the steps of providing alignment monitors and aligning said loaded reel under said semi-submersible vessel using said alignment monitors.

3. The method of claim 2, wherein said alignment monitors control thrusters transporting said loaded reel.

4. The method of claim 2, wherein said semi-submersible vessel provides a reference source to said alignment monitors.

5. The method of claim 1, further comprising the steps of:

providing a transport vessel;

providing the loaded reel art on said transport vessel; and wherein the positioning step includes positioning the transport vessel with said loaded reel under said submersible vessel.

6. The method of claim 5, further comprising the steps of providing a motion suppression apparatus wherein, the positioning step includes using said motion suppression apparatus comprises control devices which activate and deactivate compressors, thereby maintain equilibrium of the displacement force of said transport vessel and hydrostatic force of the water plane.

7. The method of claim 1, further comprising the step of engaging and securing a spindle.

8. A method for installing product with a semi-submersible vessel comprising the steps of:

providing a first reel that is loaded with product;

positioning said first reel under said semi-submersible;

connecting a lifter to said first reel;

lifting said first reel toward the underside of said semi-submersible;

securing said first reel to the underside of said semi-submersible vessel by engaging a fastener;

attaching a lead line to said product;

unspooling said product from said reel with said lead line;

associating said product with a dead weight; and lowering said dead weight into the installation site.

9. The method of claim 8, further comprising the step of engaging an alignment device.

10. The method of claim 8, further comprising the steps of securing a second reel loaded with product to said semi-submersible vessel and associating the product of said second reel with the product of said first reel.

11. A reel and cassette mechanism with improved failure characteristics comprising:

a reel positioned in a cassette, wherein said reel comprises a first horizontal surface and a cylinder having a first and second end, wherein said second end of said cylinder is connected to said first horizontal surface; and said cassette comprises a bottom, a surface rising from said bottom and an air inlet into said bottom; and an air compressor which supplies compressed air into said inlet, to generate a pressure exerted upon said horizontal surface sufficient to create air cushion for supporting said cassette above said bottom.

12. The reel and cassette of claim 11, wherein said bottom is circular.

13. The reel and cassette of claim 11, wherein the shape of said horizontal surface is adaptable to the shape of said bottom.

14. A semi-submersible vessel comprising:

a deck having an underside;

a plurality of columns having a top and a bottom, wherein said column tops are connected to said deck underside;

a plurality of pontoons, wherein said column bottoms are connected to one of said pantoons;

a lifter for lifting a product supply source torwards said deck underside;

a connector attached to said lifter, wherein said connector is engageable with said product supply source; and a fastener engagable with said product source to secure said product source to said deck underside.

15. The semi-submersible vessel of claim 14, wherein said product supply source is a reel.

16. The semi-submersible vessel of claim 14, wherein said product supply source is a reel and cassette apparatus.

* * * * *